US005652596A

United States Patent [19]

Abrams et al.

[11] Patent Number: 5,652,596

[45] Date of Patent: Jul. 29, 1997

[54] SCANNED ANTENNA SYSTEM AND METHOD

[75] Inventors: Richard L. Abrams, Pacific Palisades; Jan Grinberg, Los Angeles; K. C. Lim, Agoura; Ronald I. Wolfson, Los Angeles, all of Calif.

[73] Assignee: Hughes Electronics, Los Angeles, Calif.

[21] Appl. No.: 532,371

[22] Filed: Sep. 22, 1995

[51] Int. Cl.[6] ..... H01Q 19/06

[52] U.S. Cl. ..... 343/754; 343/785

[58] Field of Search ..... 343/772, 754, 343/785, 771, 711, 713; H01Q 19/06, 15/02, 15/04

[56] References Cited

U.S. PATENT DOCUMENTS 5,266,961 11/1993 Milroy ..... 343/772

OTHER PUBLICATIONS

Markus, John, et al., *McGraw–Hill Electronics Dictionary*, McGraw–Hill Publishing, New York, 5th Edition, 1984, p. 390 no month.

Stimson, George, *Introduction to Airborne Radar*, Hughes Aircraft Company, El Segundo, 1983, pp. 577–580 no month.

Pedrotti, S. J., et al., *Introduction to Optics*, Prentice Hall, Englewood Cliffs, 2nd edition, 1993, pp. 349–359 no month.

*Primary Examiner*—Michael C. Wimer

*Attorney, Agent, or Firm*—Vijayalakshmi Duraiswamy; Wanda K. Denson-Low

[57] ABSTRACT

A compact scanned antenna which includes a radiator, a rotatable tube and a line source. The radiator is formed by plating a shaped dielectric core. It generates an antenna beam at an output aperture in response to a microwave signal at an input port. The line source generates a radiation sheet which is directed across a signal plane to the input pot. The tube has a cylindrical wall which is positioned across the signal plane. As the tube rotates, refractive or diffractive transmission structures pass through the signal plane. The refractive structures include linear segments which refract the wavefront of the radiation sheet. Because the wavefront slope at the radiator's aperture is a function of the wavefront slope at its input port, the antenna beam is scanned. The linear contour segments have the same inclination but are not colinear. This arrangement reduces the thickness of the tube wall. Phase coherence is achieved by an appropriate radial spacing of adjacent ends of contour segments. The diffractive structures are arranged to vary the spacing of diffraction rings as they pass through the signal plane. This produces scanned, first-order antenna beams. The line source is adapted to direct a predetermined one of these beams into the radiator.

54 Claims, 14 Drawing Sheets

SCANNED ANTENNA SYSTEM AND METHOD

BACKGROUND OF THE INVENTION

1. Field of the Invention

The present invention relates generally to microwave and millimeterwave scanned antennas.

2. Description of the Related Art

There is a growing commercial demand for low-cost radar systems. For example, investigators around the world are working on the development of obstacle-avoidance radar systems for use in motor vehicles, e.g., automobiles, trucks, boats, military vehicles and aircraft. A key element of these radar systems is an antenna that can radiate a scanned microwave beam. Obstacles that are interrogated by the scanned beam cause an echo which is received by the antenna and sent to an electronic portion of the radar for processing.

For a collision-avoidance radar to be commercially viable, its elements, such as the scanned antenna, must be light weight, low cost, spatially compact and offer efficient performance with low maintenance costs over a long lifetime (e.g., >10 years). In addition, the scanned antenna should preferably be based on manufacturing technologies that are well developed so as to reduce technical and schedule risks.

Prior art apparatus for scanning an antenna beam have generally fallen into two groups, mechanically-scanned antennas and electronically-scanned antennas. Gimbal systems have been extensively used in aircraft to facilitate the mechanical scanning of fixed-beam antennas. However, gimbal systems are typically heavy and costly to fabricate and usually require considerable maintenance.

In one exemplary type of electronically-scanned, movable waveguide vanes vary the phase of radiation through waveguide slots (e.g., see Markus, John, et al., *McGraw-Hill Electroncis Dictionary*, McGraw-Hill, New York, 5th Edition, 1994, p. 390). These systems involve a large number of moving parts so that both fabrication and maintenance costs tend to be high.

In another exemplary type of electronically-scanned, a plurality of phase shifters, e.g., ferrite and electronic, provide beam steering (e.g., see Stimson, George W., *Introduction to Airborne Radar*, Hughes Aircraft Company, El Segundo, 1983, pp. 577–580). Phased arrays can achieve high-speed scanning but the phase shifters and associated parts, e.g., waveguide networks and amplifiers, result in complex fabrication and high parts count.

SUMMARY OF THE INVENTION

The present invention is directed to efficient, light-weight, spatially-compact, low-cost scanned antennas which offer the prospect of low maintenance over a long lifetime.

This goal is realized with the recognition that an rf energy sheet with a wavefront can be successively processed with a plurality of different transfer functions to generate a processed, rf energy sheet which has successive wavefronts whose spatial orientations are each a function of a different one of the transfer functions. Because the wavefronts have different, successive spatial orientations, the processed, rf energy sheet is scanned in successively different directions.

The different transfer functions are realized with transmission structures which are formed in a wall that is passed through the rf energy sheet and the transmission structures are positioned in the wall so that they are placed successively across the rf energy sheet. The transmission structures are preferably realized with refractive surfaces and diffraction gratings.

In a scanned antenna which incorporates these concepts, the rf energy sheet is processed with a plurality of different refractive contours. The refractive contours are formed in a cylindrical wall which is rotated through the rf energy sheet. The refractive contours are positioned so that the wall rotation successively places them across the rf energy sheet. The wall thickness is reduced by realizing the contours with linear segments which have substantially the same inclination but which are not colinear.

Phase coherence is obtained in this refractive structure by spacing adjacent ends of the linear segments with an offset step which has a dimension of $N\lambda/(n-1)$, in which $\lambda$ is the energy wavelength, N is a positive integer and n is the refraction index of the wall. Linearity between the scan rate of the processed rf energy sheet and the rotation of the cylindrical wall is obtained by positioning the offset steps of adjacent contours along a line which is defined by a hyperbola if the cylindrical wall is rolled out into a planar configuration.

The rf energy sheet is preferably formed with a line source which has a plurality of linearly-spaced, radiative elements. In one embodiment of the line source, the radiative elements are slots in a wall of a waveguide and the waveguide is received within the cylindrical wall.

In another scanned antenna, the rf energy sheet is processed with a diffraction grating which is formed on a cylindrical wall with a plurality of diffraction rings. The diffraction rings are arranged to have successively different spacings across the rf energy sheet as the cylindrical wall is rotated. The diffraction rings process the rf energy sheet into a zero-order, rf energy sheet and a pair of first-order, rf energy sheets and the different spacings of the diffraction rings successively scan the first-order, rf energy sheets to successively different directions.

Scanned antenna embodiments are also realized by forming the refractive surfaces and the diffraction gratings in the walls of belts and passing the belts across the rf energy sheet.

After the rf energy sheet has been processed by refraction or by diffraction, other scanned antenna embodiments are formed by receiving the processed, rf energy sheet into a parallel-plate waveguide and radiating portions of the processed, rf energy sheet from a plurality of parallel-plate stubs which issue from one of the plates of the parallel-plate waveguide.

In the diffractive embodiments, a predetermined one of the first-order, rf energy sheets is received into the parallel-plate waveguide and radiated from the parallel-plate stubs. The predetermined energy sheet is directed into the parallel-plate waveguide by appropriately spacing the linearly-spaced radiative elements of the line source which forms the rf radiation sheet. Preferably, the energy in the predetermined, first-order, rf energy sheet is then enhanced by, blazing the diffraction rings.

The novel features of the invention are set forth with particularity in the appended claims. The invention will be best understood from the following description when read in conjunction with the accompanying drawings.

DESCRIPTION OF THE PREFERRED EMBODIMENTS

Figure 2:
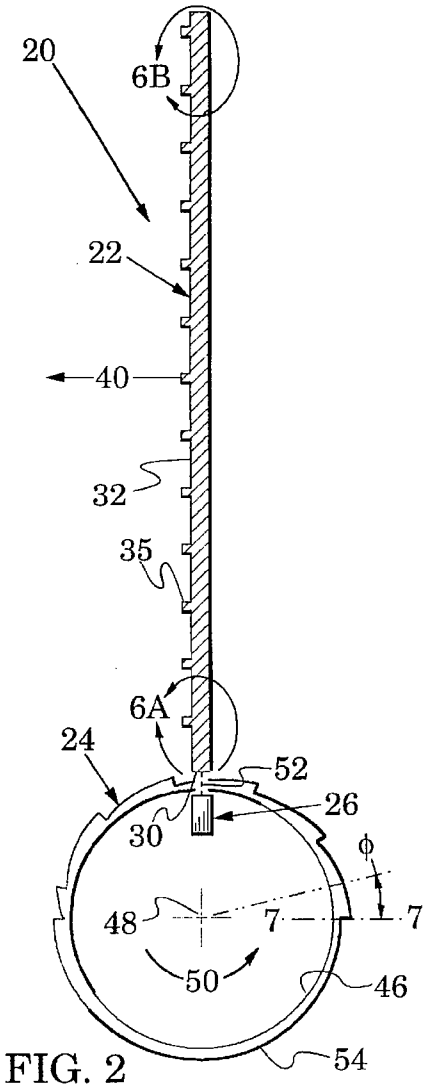
FIG. 2 is side elevation view of the scanned antenna of FIG. 1.
Figure 1:
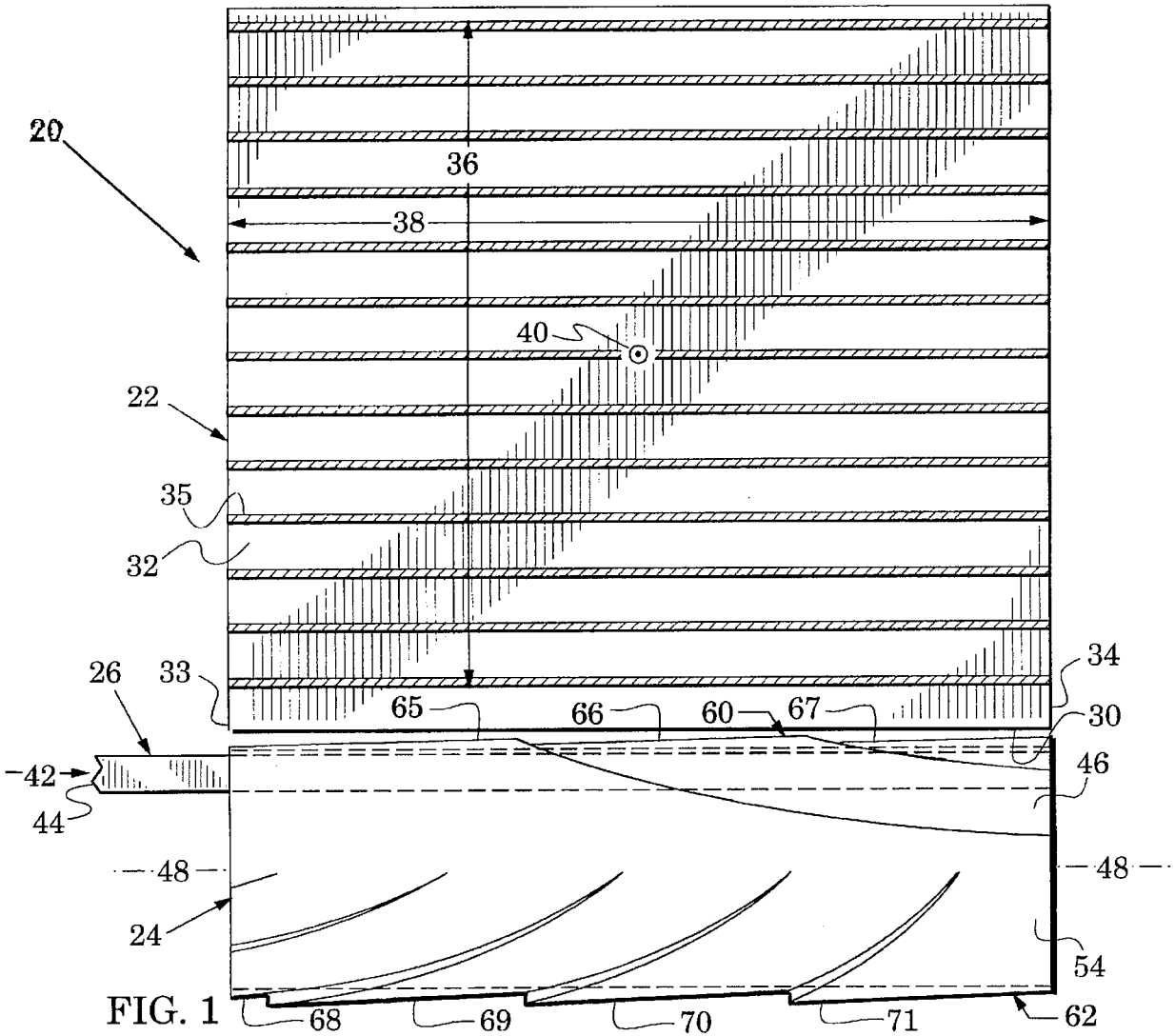
FIG. 1 is a front elevation view of a scanned antenna in accordance with the present invention.
Figure 4:
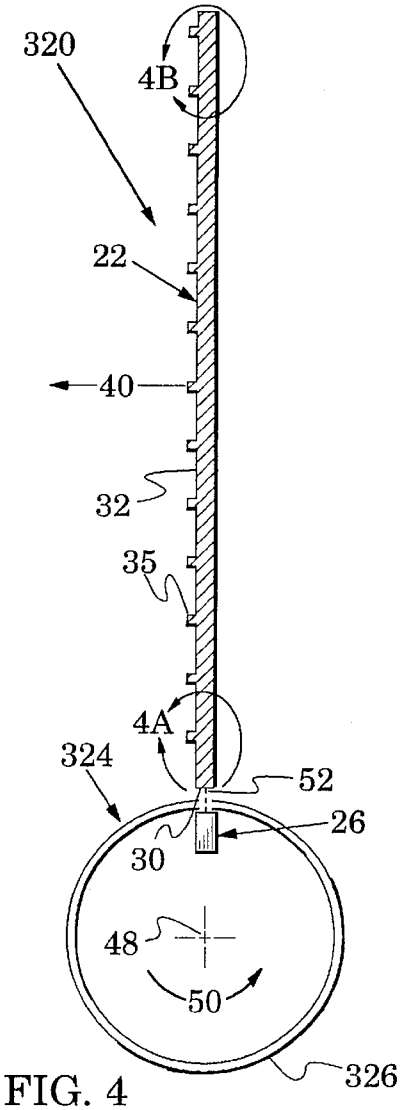
FIG. 4 is side elevation view of the scanned antenna of FIG. 3.
Figure 3:
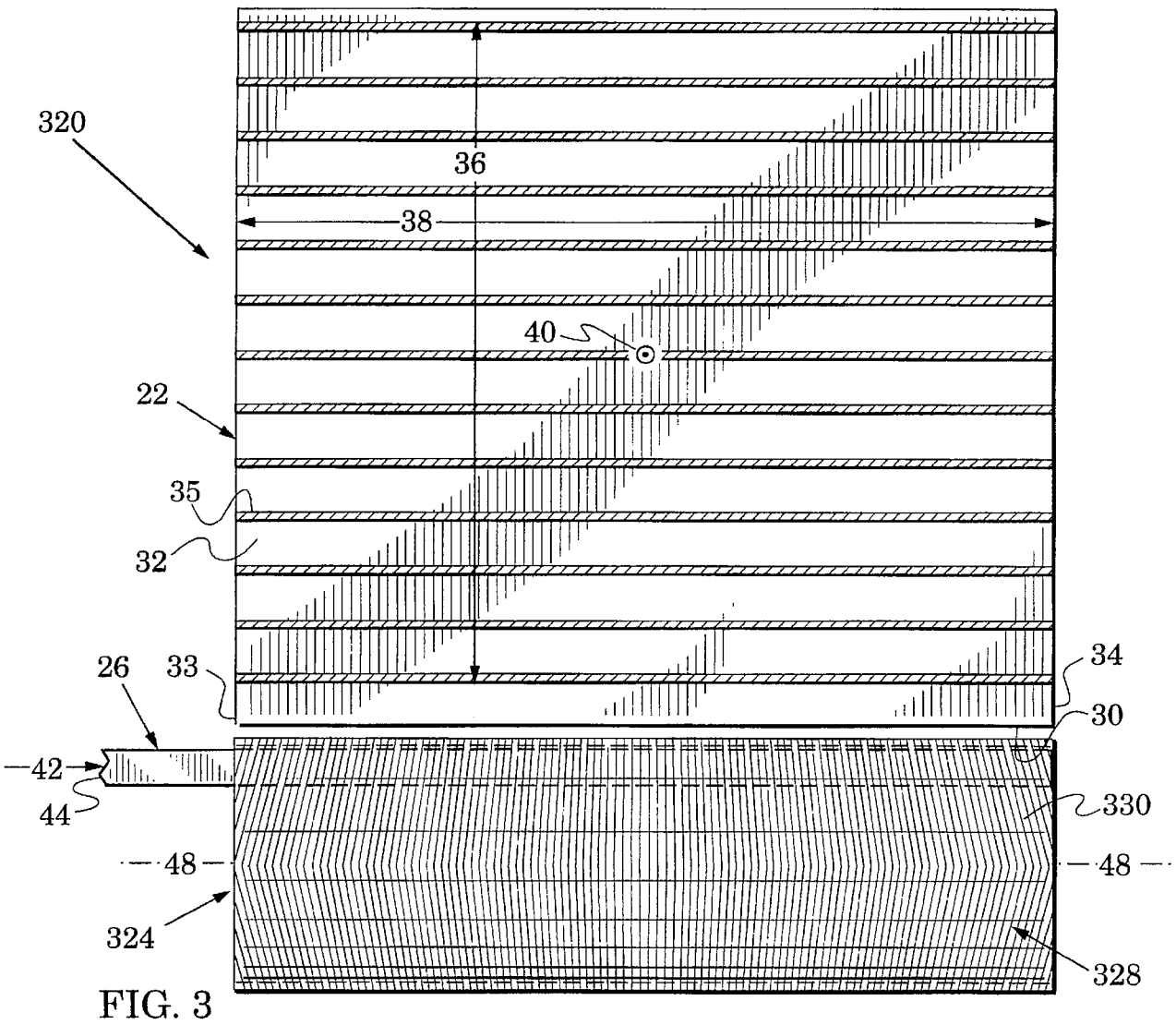
FIG. 3 is a front elevation view of another scanned antenna in accordance with the present invention.

FIGS. 1 and 2 illustrate a scanned antenna 20 and FIGS. 3 and 4 illustrate another scanned antenna 320. In accordance with the present invention, each of the scanned antennas 20 and 320 form an rf energy sheet which has a wavefront and then successively process this rf energy sheet with a plurality of different transmission structures to generate a processed, rf energy sheet which has successive wavefronts with different spatial orientations. Because the wavefronts have different, spatial orientations, the processed, rf energy sheet is scanned in successively different directions.

Attention is first directed to the detailed structure of the scanned antenna 20. Subsequent to a description of this structure, attention will be directed to a detailed structure of the scanned antenna 320.

The antenna 20 includes a first radiative member in the form of a radiator 22, a rotatable, refractive member in the form of a tube 24 and a second radiative member in the form of a line source 26.

The radiator 22 has an input port 30 and an output aperture 32. The input port 30 has a rectangular shape and extends between the radiator sides 33 and and 34. The aperture 32 is formed by a plurality of transverse stubs or ribs 35 which, together, define the aperture's vertical extent 36 and the aperture's horizontal extent 38. The aperture's mechanical boresight 40 is orthogonal to the aperture 32 and extends outward from the aperture's geometric center. It is indicated in FIGS. 1 and 2 by an arrow. In describing an antenna beam radiated from the aperture 32, it is helpful to define an elevation plane of the aperture as a plane through the boresight 40 that is orthogonal to the transverse ribs. 35 and an azimuth plane of the aperture as a plane through the boresight 40 that is parallel with the transverse ribs 35.

The line source 26 is spaced from the radiator's input port 30 and is configured to illuminate the input port 30 in response to an rf signal 42 which is inserted into the entrance 44 of the line source 26.

The refractive tube 24 has an cylindrical wall 46 which is defined about a rotational axis 48 of the tube. The cylindrical wall 46 is formed of a material that has a refractive index n. The tube 24 is positioned to receive the line source 26 within the cylindrical wall 46. As the tube 24 is rotated (indicated by the direction arrow 50), radial planes of the cylindrical wall 46 successively pass through a signal plane 52 which extends between the line source 26 and the radiator's input port 30.

The outer surface 54 of the cylindrical wall 46 is configured to define a plurality of different contours as the wall rotates through the signal plane 52. In FIG. 1, a top portion of a first one 60 of these contours is visible at the top of the refractive tube 24 and a bottom portion of a second one 62 of these contours is visible at the bottom of the refractive tube. The contour 60 includes three linear segments 65, 66 and 67. Each of these segments has the same inclination with respect to the rotational axis 48 but they are not colinear. In a similar manner, the contour 62 includes four linear segments 68, 69, 70 and 71. Each of these segments also has the same inclination with respect to the rotational axis 48 but they are not colinear.

In operation, the line source 26 responds to the rf signal 42 at its entrance port 44 and directs a sheet of radiation across the signal plane 52 to the input port 30 of the radiator 22. The radiator 22 forms an antenna beam from this radiation sheet and radiates the beam from the aperture 32. The azimuth bearing of this antenna beam is a function of the angle of the radiation wavefront along the signal plane 52. As the refractive tube 24 rotates about its rotation axis 48, its contours in the signal plane 52, e.g., the contours 60 and 62, refractively alter the wavefront angle. Consequently, the wavefront at the radiator input port 30 tilts back and forth and, in response, the antenna beam from the aperture 32 is scanned back and forth azimuthly.

The operation of the scanned antenna 20 can be better understood with a detailed knowledge of the structures of the radiator 22, the line source 26 and the refractive tube 24. Accordingly, these elements will first be described with reference to FIGS. 5–13. After this description of antenna elements, attention will be returned to the scanned antenna 20 of FIGS. 1 and 2 and its operation.

The radiator 22 is shown in FIGS. 5A, 5B, 6A and 6B to have a core 82 which is formed of a low-loss dielectric (e.g., Rexolite which has a loss tangent of ~0.0003). The core 82 includes a rectangular panel 84 that has a height 86 and a width 88 (which equals the aperture width 38 in FIG. 1). The core 82 also includes a plurality of parallel ribs 90 which extend orthogonally from one side of the panel 84 and span the transverse distance between the radiator sides 33 and 34. The ribs 90 have sides 92 which terminate at a face 94.

The broad sides of the panel 84 are plated with a metal, e.g., copper, which forms a parallel-plate waveguide 95 from a pair of spaced, parallel plates 96 and 97. The sides 92 of the ribs 90 are also metallically plated as is the top edge 98 of the panel 84. The face 94 of the ribs 90 and the panel's sides 33 and 34 and bottom edge 99 are not plated. The unplated faces 94 and panel sides 33 and 34 are hatched for clarity of illustration. The panel 84 and its plates 96 and 97 form the parallel-plate waveguide 95. The ribs 90 and their plated sides 92 form the transverse stubs 35 which protrude outward from the plate 96.

The structure of the radiator 22 forms the input port 30 and the output aperture 32. The input port 30 is the space between the parallel plates 96 and 97 that extends between the radiator sides 33 and 34. The output aperture 32 is formed by the plurality of transverse stubs 35. An antenna's aperture is its radiating area, so the aperture 32 has a height 36 and a width 38 which are defined by the stubs 35. The mechanical boresight 40 extends orthogonally from the center of the aperture 32.

Figure 6B:
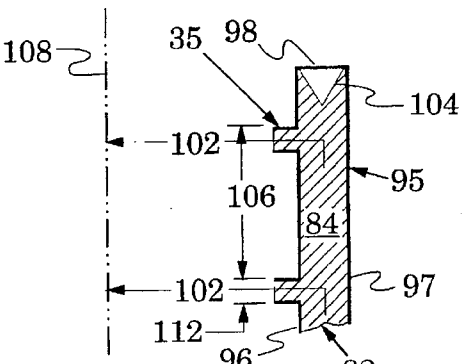
FIG. 6B is an enlarged view of the structure within the curved line 6B of FIG. 2.
Figure 6A:
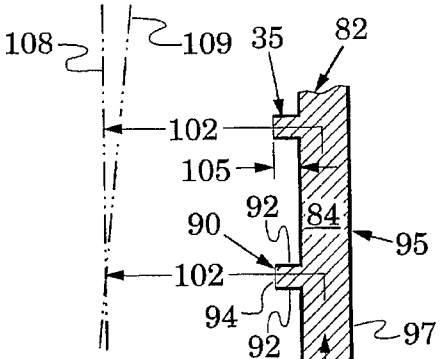
FIG. 6A is an enlarged view of the structure within the curved line 6A of FIG. 2.

In operation of the radiator 54, an rf signal 100 is inserted into the input port 30 as shown in FIG. 6A. The rf energy travels up the waveguide formed between the parallel plates 96 and 97. At each transverse stub 35, a portion 102 of the energy is conducted between the plated rib sides 92 and radiated across the rib face 94. The remainder of the rf energy continues upward in the panel 84 until it supplies the last transverse stub 35 (the stub that is adjacent the top panel edge 98). To reduce energy reflections from the top edge 98 of the radiator, the end of the parallel-plate waveguide is preferably filled with a load 104 which is formed from an energy-absorbent material. The radiated energy portions 102 combine to form an antenna beam. The height 105 of the ribs 70 is preferably adjusted to enhance the impedance match between free space and the parallel-plate waveguide 95.

The wavelength $\lambda_g$ of the rf energy within the waveguide 95 is a function of the dielectric constant of the core 82 and the physical guide dimensions. If the spacing 106 (shown in FIG. 6B) of the transverse stubs 35 is an integer number of wavelengths $\lambda_g$, then the energy issuing from each transverse stub 35 is in phase and a radiation wavefront 108 (a wavefront is a radiation surface of constant phase) will be parallel with the panel 84. Because an antenna beam is always orthogonal with its rf wavefront, the antenna beam's axis will then be colinear with the antenna's mechanical boresight (40 in FIGS. 1 and 2).

The wavefront can be tilted in the aperture's elevation plane by fabricating the radiator with other spacings 106. For example, if the spacing 106 is fabricated to be greater than an integer number of wavelengths $\lambda_g$, a tilted wavefront 109 will be realized as indicated in FIG. 6A. The tilted wavefront will cause the antenna beam's axis to tilt upward in the aperture's elevation plane.

The radiated power distribution along the radiator's elevation plane can be controlled by adjusting the width 112 (shown in FIG. 6B) of each transverse stub 35. The energy of the input signal 100 (in FIG. 6A) declines as it flows upward past the transverse stubs 35 because a portion of it is radiated from each stub. To cause the power of the radiation 102 from each stub 79 to be substantially constant, the width 112 preferably increases monotonically from the stub nearest the input port 30 to the stub nearest the panel top edge 98.

Figure 5B:
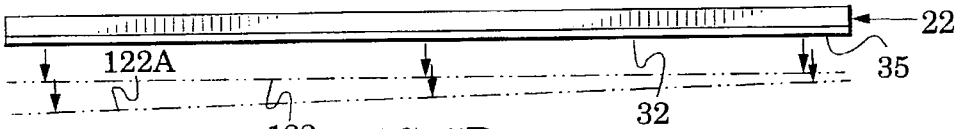
FIG. 5B is a top plan view of the radiator of FIG. 5A.

In the aperture's azimuth plane, the wavefront orientation at the aperture 32 is a function of the the wavefront orientation at the input port 30. For example, the wavefront 120 is parallel with the input port 30 in FIG. 5A. Because the distance from this wavefront 120 is constant to all portions of each transverse rib 35, an output wavefront 122 will be parallel with the aperture 33 as shown in FIG. 5B. It follows that if the input wavefront is tilted to the position 120A, the output wavefront will be tilted to the position 122A.

Tilting the wavefront at the input port 30 changes the phase distribution of the input signal across the input port 30, and tilting the wavefront across the aperture 32 changes the phase distribution across the aperture. Therefore, in terms of phase distribution, the phase distribution across the output aperture 33 is a function of the phase distribution across the input port 30. Since the radiated antenna beam will be orthogonal to the wavefront 122, the azimuth bearing of the antenna beam is controlled by the phase distribution across the input port 30.

The radiator 22 belongs to a type of rf structure generally known as continuous transverse stubs (CTS). CTS structures are described in detail in U.S. Pat. No. 5,266,961 which issued Nov. 30, 1993 and was assigned to Hughes Aircraft Company, the assignee of the present invention.

Figure 7C:
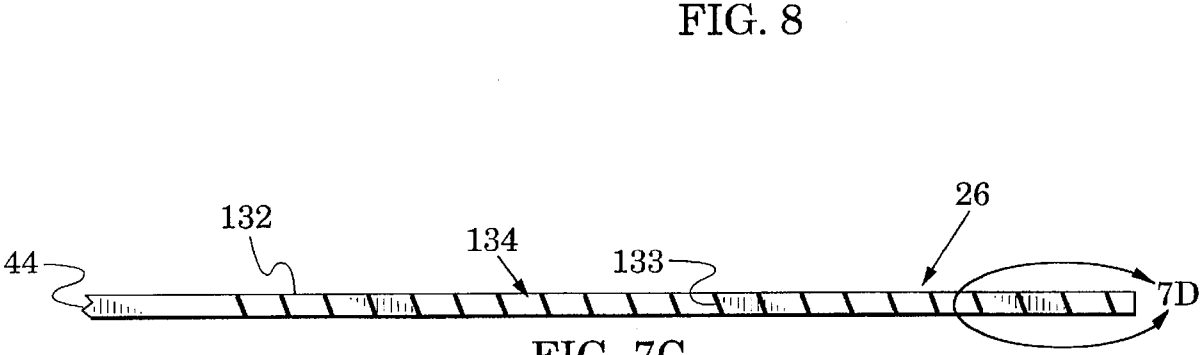
FIG. 7C is a top plan view of the line source of FIG. 7A.
Figure 7A:
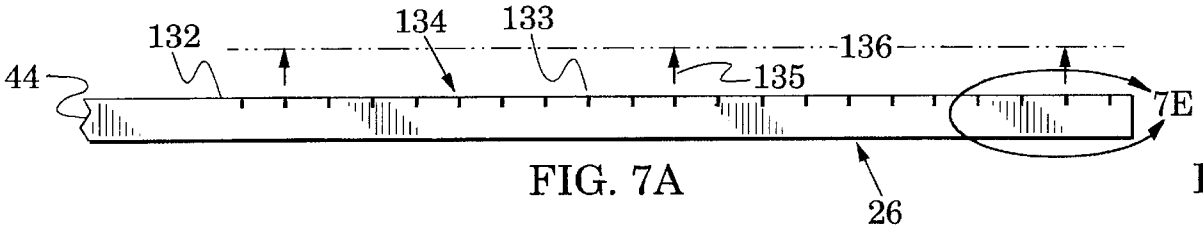
FIG. 7A is a front elevation view of a line source in the scanned antenna of FIGS. 1 and 2.
Figure 7B:
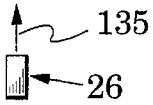
FIG. 7B is a side elevation view of the line source of FIG. 7A.

FIGS. 7A–7C illustrate the line source 26 of FIGS. 1 and 2. The line source 26 has a transmission member in the form of a waveguide 132. The waveguide has an open end which forms the entrance 44 and a plurality of linearly-aligned, spaced radiators in the form of transverse slots 133 which form its exit aperture 134. Portions of an rf signal at the entrance 44 exit from each slot 133 as radiation 135 which has a wavefront 136. If the openings 133 are spaced by the waveguide's wavelength $\lambda_g$, the wavefront 136 will be parallel with the waveguide 132.

Structures such as the source 26 are called line sources for the obvious reason that they generate a planar sheet of radiation as represented by the radiation arrows 135. In FIG. 1, this planar radiation sheet is directed along the signal plane 52.

In general, the line source of the invention can be any transmission line that forms a plurality of linearly-aligned, spaced radiators. One embodiment of waveguide radiators are the angled transverse slots 133 but other source embodiments can be formed with any well-known waveguide radiator, e.g., holes and longitudinally-aligned slots.

Figure 7D:
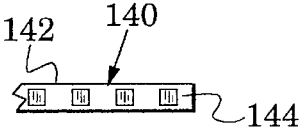
FIG. 7D shows another embodiment of the structure within the curved line 7D of FIG. 7C.

Any transmission line and spaced radiators can form other embodiments of the line source. For example, FIG. 7D illustrates another line source embodiment 140 which has alternative structure for the structure within the curved line 7D of FIG. 7C. The line source 140 has a transmission member in the form of a dielectric rod 142. The rod 142 carries a plurality of linearly-aligned, spaced radiators in the form of conductive patches 144. The patches are generally formed by copper plating on the dielectric rod 142. The rf energy is directed along the dielectric rod 142 by total internal reflection because the material of the rod is selected to have a dielectric constant which is larger than that of the surrounding air. The rod material should preferably also have a low loss tangent.

Figure 7E:
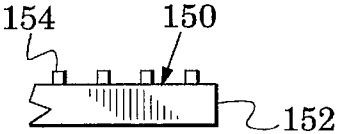
FIG. 7E shows another embodiment of the structure within the curved line 7E of FIG. 7B.

FIG. 7E shows another line source embodiment 150 which has alternative structure for the structure within the curved line 5E of FIG. 7A. The line source 150 has a transmission member in the form of a dielectric rod 152 which is shaped to define a plurality of linearly-aligned, spaced dielectric tubes 154. The tubes radiate energy in a manner similar to that of the transverse stubs 35 in FIGS. 6A and 6B.

Figure 9:
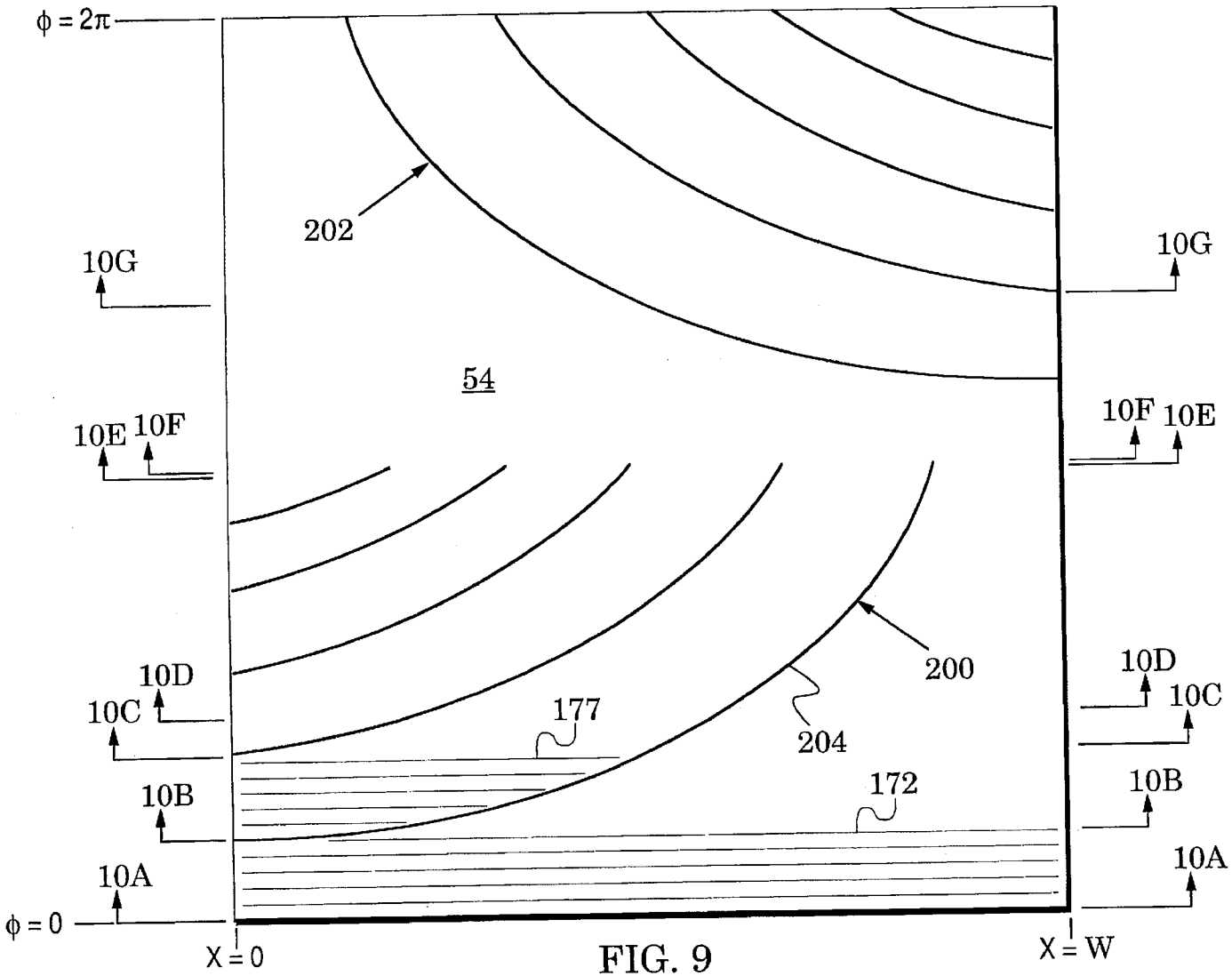
FIG. 9 is a plan view of the refractive tube of FIG. 8 after it has been cut along the radial plane 9—9 of FIG. 2 and rolled into a planar configuration.

The refractive tube 24 is illustrated in FIGS. 8, 9, 10A–10G, 11, 12 and 13. As previously stated, the cylindrical wall of the tube is formed of a material that has a refractive index n. FIG. 9 shows the outer surface 54 of the tube wall (46 in FIG. 2) as it would appear if the wall were axially cut along the plane 9—9 of FIG. 2 and rolled out into a planar configuration. FIGS. 10A–10G illustrate the wall contours 161–167 along the planes 10A—10A to 10G—10G of FIG. 9. As the refractive tube 24 rotates, as indicated by the direction arrow 50 of FIG. 2, these exemplary tube contours successively appear across the signal plane 52.

Figure 10A:
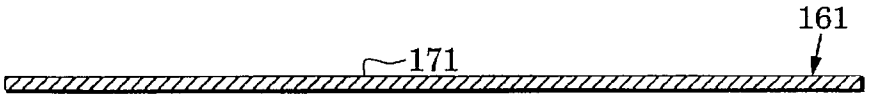
FIGS. 10A–10G are enlarged sectional views along the the planes A—A, B—B, C—C, D—D, E—E, F—F and G—G, respectively of FIG. 9.
Figure 10B:
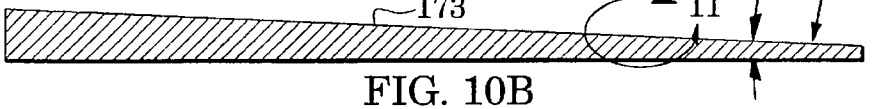
Figure 10C:
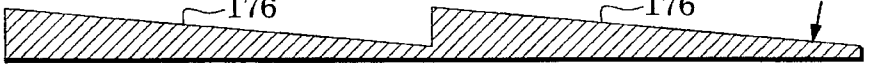
Figure 10D:
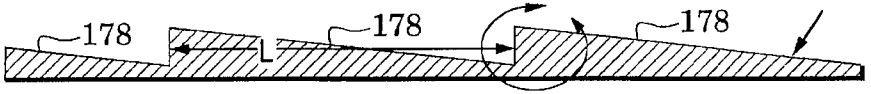
Figure 10E:
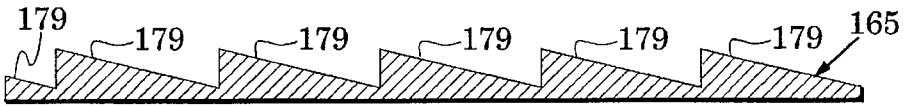
Figure 10F:
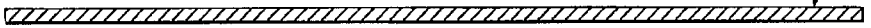
Figure 10G:
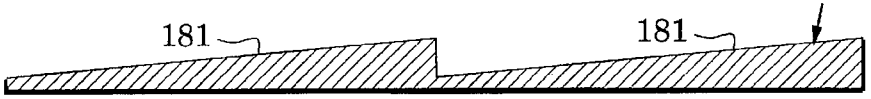

FIG. 10A shows that the tube 24 is a thin rectangular wall in the plane 10A—10A. In this contour 161, the outer surface is a single linear segment 171. The inclination of segments that correspond to the segment 171 progressively increase along the exemplary planes 172 of FIG. 9 until they obtain a maximum inclination shown in the segment 173 of the contour 162 of FIG. 8B.

Figure 11:
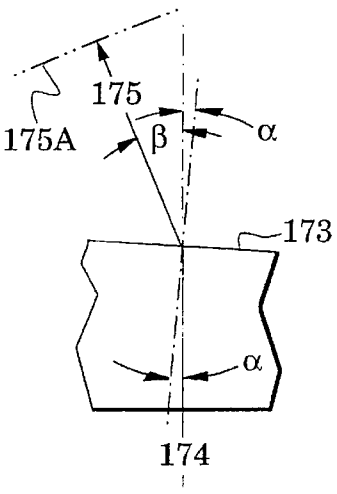
FIG. 11 is an enlarged view of the structure within the curved line 11 of FIG. 10B.

FIG. 11 indicates the refractive bending that occurs when a radiation ray 174 at an incident angle g passes the contour segment 173. As governed by Snell's Law, the ray 174 will be refracted along a new path 175 defined by a deflection angle β in which $$\sin(\alpha+\beta)=n\sin\alpha. \quad (1)$$

The portion of the rf energy that crosses the contour segment 173 will be directed parallel to the path 175 and have a wavefront 175A that is orthogonal to the path 175.

Above the plane 10B—10B of FIG. 9, the surface contour has two linear segments whose inclination progressively increases along the exemplary planes 177 until reaching a maximum inclination shown in the segments 176 of the contour 163 of FIG. 8C. Above the plane 10C—10C, the surface contour has three linear segments 178 as shown in the contour 164 of FIG. 10D. This sequence of added contour segments continues until the contour 165 of FIG. 10E has six linear segments 179. The segments of each contour have substantially the same inclination but are not colinear.

Figure 12:
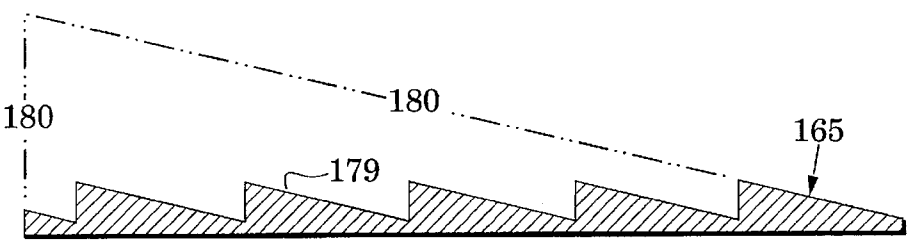
FIG. 12 is a view similar to FIG. 10E, which illustrates a thin tube wall that is obtained with the teachings of the invention.

The inclination of the contour segments increases from FIG. 10A to FIG. 10E which will cause an increasing slope of the wavefront of the radiation sheet which passes through these contours. This change in the wavefront slope will cause an azimuthal scan of the antenna beam from the aperture 32 of the radiator 22. The angular scan of the antenna beam will equal the deflection β across the contour segments. In accordance with a feature of the invention, a large inclination of contour segments (with consequent large deflection angle β) is achieved with a relatively thin tube wall (46 in FIG. 2). For example, if the tube wall 46 were configured with only a single contour segment, a much thicker tube wall would result. This is illustrated in FIG. 12 which is a view similar to FIG. 10E. The broken lines 180 indicate a contour with a single linear segment that has the same inclination as the segments 179. This configuration requires a significantly thicker wall.

The contours 161–165 of FIGS. 10A–10E cause an increasing deflection (β in FIG. 11) of radiation towards the left side of the tube 24. The contours in the upper part of the tube surface 54 of FIG. 9 are the same as those in the lower part except that they are horizontally reversed. For example, the contour 167 and its linear segments 181 are the horizontally reversed equivalents of the contour 163 of FIG. 10C. Thus, the contours of the upper part of the tube surface 54 of FIG. 9 cause an increasing deflection β of radiation towards the right side of the tube 24.

Figure 5A:
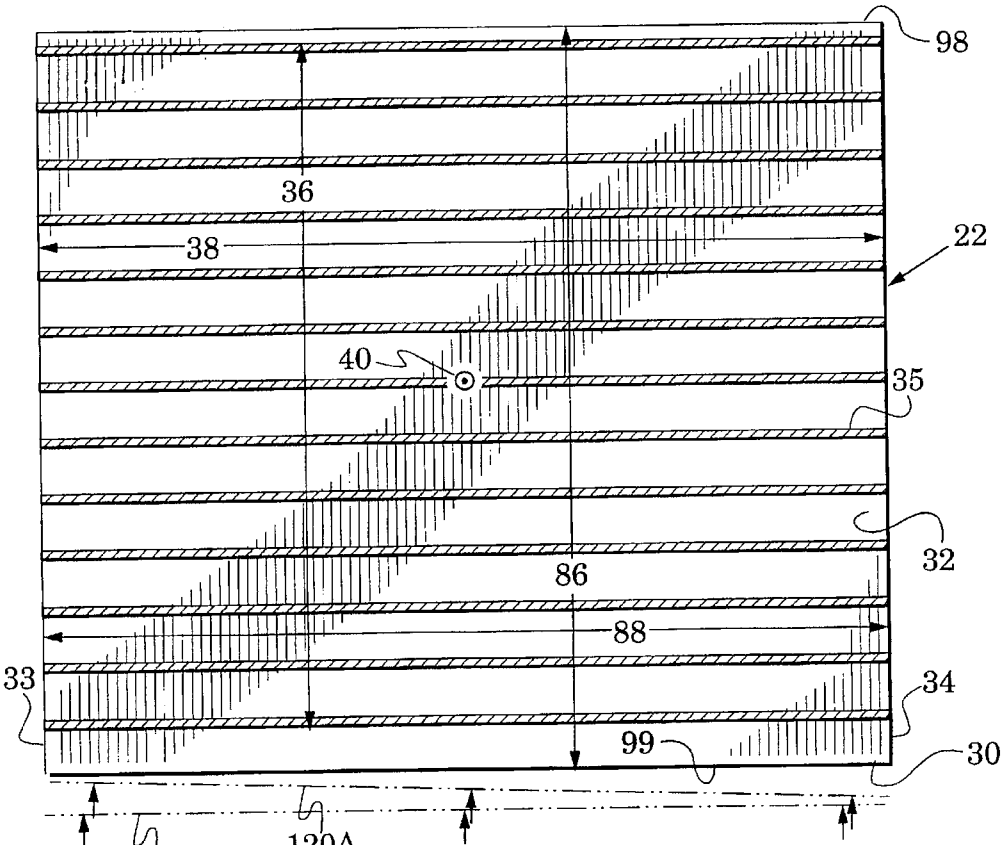
FIG. 5A is a front elevation view of a radiator in the scanned antenna of FIG. 1.
Figure 8:
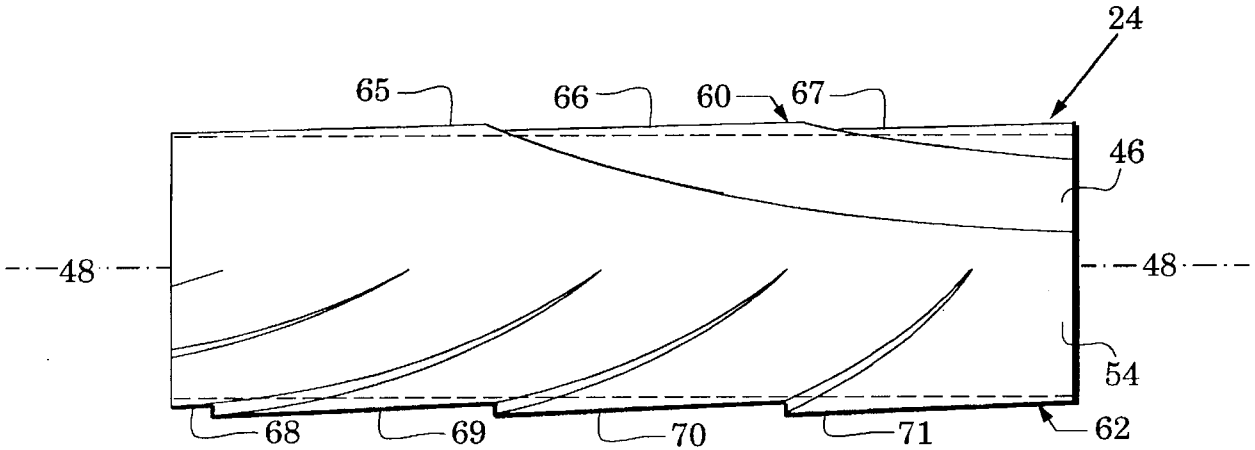
FIG. 8 is a side elevation view of a refractive tube in the scanned antenna of FIGS. 1 and 2.

Having described the basic structure of the radiator 22, the line source 26 and the refractive tube 24, attention is now returned to the operation of the scanned antenna 20 of FIGS. 1 and 2. Insertion of the rf signal 42 into the line source entrance 44 causes a sheet of rf energy to be radiated from the line source's exit aperture (134 in FIGS. 7A and 7C). This radiation sheet is directed across the signal plane 52 of FIG. 2 that extends between the exit aperture and the input port 30 of the radiator 22. The refractive tube 24 rotates as indicated by the direction arrow 50 so that the tube wall 46 defines a plurality of contours, e.g., the contours 161–167 of FIGS. 10A–10G, in the signal plane 52. As the sheet of rf energy passes across the linear segments of these contours, its wavefronts are tilted back and forth and these altered wavefronts are received into the input port 30 of the radiator 22. As shown in FIGS. 5A and 5B, this wavefront tilting at the input port 30 causes an equivalent tilting of the wavefront out of the radiator aperture 32. Thus, the antenna beam will be scanned in the azimuth plane of the radiator aperture 32.

The radiation that is refracted away from each of the linear segments of FIGS. 10A–10G will be in phase along a segment wavefront. However, the segment wavefronts do not necessarily align in a common wavefront for the entire refractive tube 24. An antenna beam that is formed from this rf energy will accordingly have high side lobe energy. Energy in side lobes is generated at the cost of energy which could have been converted into the main antenna lobe. This means the antenna system is not as efficient as it could have been.

In accordance with another feature of the invention, the contour linear segments of FIGS. 10A–10G are adapted so that the wavefronts refracted from all segments of each contour are colinear. Because these wavefronts are colinear, each contour can be said to have formed a common tube wavefront. An antenna beam formed from this radiation will have its side lobe energy decreased, i.e., its main lobe energy will be increased and the system efficiency increased accordingly. This improvement is accomplished by appropriately adjusting the radial offset of adjacent ends of the contour segments.

Figure 13:
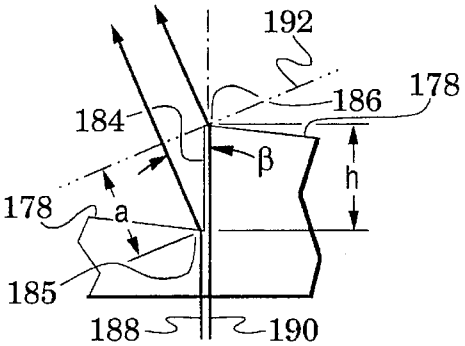
FIG. 13 is an enlarged view of the structure within the curved line 13 of FIG. 10D.

For example, FIG. 13 illustrates that the contour 164 includes a radial step 184 of height h that connects adjacent ends 185 and 186 of a pair of the segments 178. Two radiation rays 188 and 190 are shown that pass through the segments on each side of the step 184. Because the segments have the same inclination the rays both have the same deflection β. They will also be in phase along a common wavefront 192 if the path dimension a and the step height h differ by an integer number of wavelengths. Because the radiation wavelength in the tube wall (46 of FIG. 2) will be λ/n, the common wavefront requires that $h/(\lambda/n)-\alpha/\lambda=N$ in which N is a positive integer. Since $\alpha=h\cos\beta$, the step dimension becomes $$h=N\frac{\lambda}{n-\cos\beta}. \tag{2}$$

For small deflection angles, cos β is substantially one, e.g., cos 7.5°=0.99. Therefore, a step height h of substantially Nλ/(n−1) can be used to connect all of the adjacent segment ends in FIGS. 10A–10G as long as the deflection β is not allowed to significantly exceed 7.5°.

In the particular case in which N=1, the radial steps between the contour segments of the refractive tube 24 are set to have a dimension of λ/(n−1). The wavefronts from all the segments of a given contour, e.g., the contour 165 of FIG. 10E will now form a common tube wavefront. When these common wavefronts are directed across the signal plane 52 in FIG. 2, a common wavefront is radiated from the aperture 32 as shown in FIG. 5B. As a result, the side lobe energy in the antenna beam will be reduced and the scanned antenna system efficiency will be increased.

The rate of change of the deflection angle β (and, therefore, the antenna beam scan rate) may be selected as a function of the refractive tube's rotational rate. A particularly useful function is one in which the deflection angle β varies linearly with the tube's rotation angle ϕ(indicated in FIG. 2). In this case, the antenna beam's scan rate will be a linear function of the tube's rotational velocity. For this function, assume that multiple scan cycles are selected for each tube rotation and that there is a maximum deflection angle βmax. Then β is given by $$\beta-\frac{\beta_{max}}{\pi}k\phi. \tag{3}$$

Equation (1) can be rewritten as $$\cos\beta+\frac{\sin\beta}{\tan\alpha}=n \tag{4}$$

so that a substitution of equation (3) yields $$\tan\alpha=\frac{\sin\left(\frac{\beta_{max}}{\pi}\phi\right)}{n-\cos\left(\frac{\beta_{max}}{\pi}\phi\right)} \tag{5}$$

in which k has been set to 1. If the axial length of each contour segment (see L in FIG. 10C) is L, then from FIG. 10D we have tanα=h/L and substitution into equation (2) gives $$\tan\alpha=\frac{N\lambda/L}{n-\cos\left(\frac{\beta_{max}}{\pi}\phi\right)}. \tag{6}$$

Substitution of equation (6) into equation (5) obtains $$L=\frac{N\lambda}{\sin\left(\frac{\beta_{max}}{\pi}\phi\right)} \tag{7}$$

for 0<βmax (ϕ/π)<βmax. For small β, e.g., 7.5°, equation (7) can be rewritten as $$L\phi=\frac{N\lambda\pi}{\beta_{max}}. \tag{8}$$

Equation (8) represents a family of hyperbolas which, with N set to 1, are the sets 200 and 202 of curves in FIG. 9. Each of the curves is the locus for a step 184 that connects adjacent segment ends. Thus, in accordance with another feature of the invention, a linear function between antenna scan rate and tube rotational rate is obtained by defining the loci of the radial steps 184 with a family of hyperbolas.

An example of the step loci is given by the curve 204 in FIG. 9. In the contour 162 of FIG. 10B, L=W in which W is the width of the refractive tube of FIG. 8. The first step begins just above this contour as indicated by the curve 204. As this curve 204 approaches the right edge of the surface 54, the inclination of segments between the curve and the right side of the tube surface increase to a maximum as shown by the right hand segment 179 in FIG. 10E.

When the refractive tube 24 is positioned with the contour 161 across the signal plane 52 of FIG. 2, the antenna beam from the radiator aperture 32 will be on the boresight 40. As the contours 162–165 successively move across the signal plane, the antenna beam will linearly scan to its maximum azimuthal deflection. When the contour 166 moves across the signal plane 52 of FIG. 2, the antenna beam from the radiator aperture 32 will again be on the boresight 40. As the contours represented by the upper part of FIG. 9, e.g., the contour 167 of FIG. 10G, move across the signal plane, the antenna beam will linearly scan to its maximum azimuthal deflection on the opposite side of the boresight 40.

Figure 14:
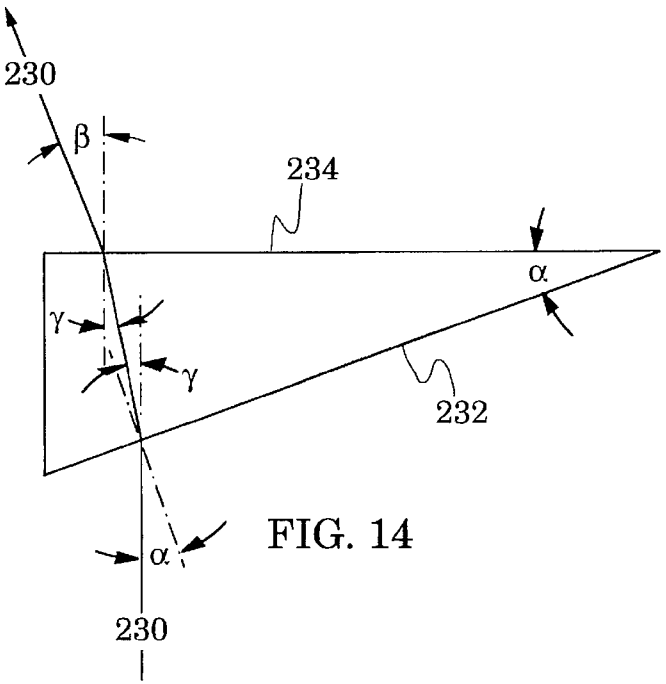
FIG. 14 is a schematic diagram of another tube wall embodiment.

The contours of FIGS. 10A–10G have been shown to be on the outer surface 54 of the refractive tube 24 but in other embodiments of the invention, they may be defined on the inner surface. For example, FIG. 14 is a schematic view which indicates how a radiation ray 230 would have a deflection β after first crossing an interior contour segment 232 which has an inclination α and then crossing an exterior wall surface 234 which has no inclination. In this configuration, Snell's Law gives sinα=nsin(α−γ) and sinβ=nsinγ which can be combined to yield $$\sqrt{n^2-\sin^2\beta}-1=\sin\beta ctg\alpha. \tag{9}$$

In comparison, equation (4) can be rewritten as $$n-\cos\beta=\sin\beta ctg\alpha. \tag{10}$$

Because 1>cosβ and n>(n2−sin2β)$^{1/2}$, the left side of equation 9 is smaller than the left side of equation 10. Therefore, for a given α, the sinβ of equation 10 will be larger than the sinβ of equation 9. This means that for a given contour segment inclination α, the radiation deflection β will be larger if the contour segment is on the outer surface 54 of the refraction tube 24.

Figure 15:
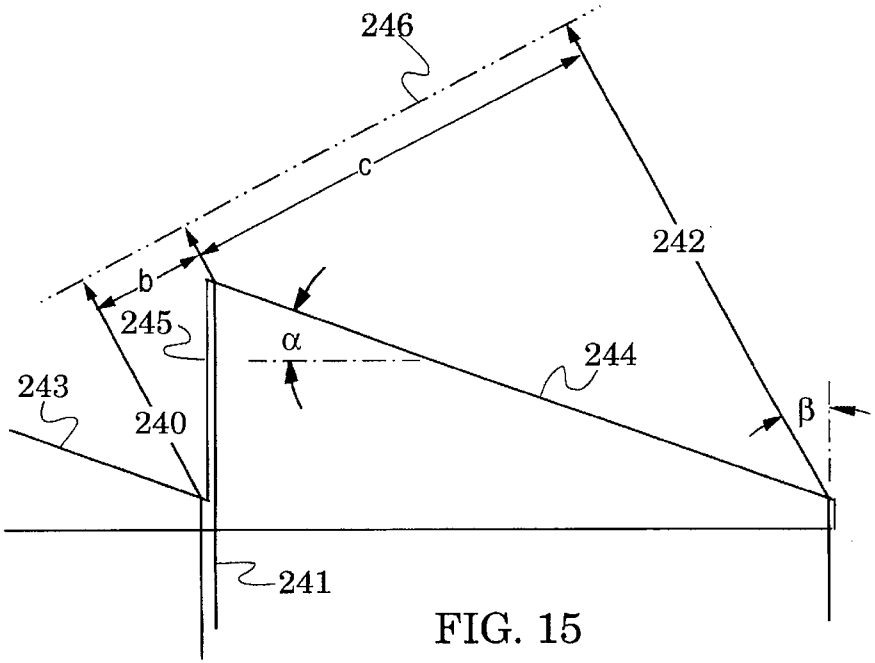
FIG. 15 is a schematic diagram which illustrates radiation gaps which are created in the antenna of FIG. 1.

The refractive efficiency of the tube 24 is considered in FIG. 15, in which radiation rays 240, 241 and 242 are refracted from contour segments 243 and 244 that are connected by a step 245. It is apparent that along the refracted wavefront 246, there will be radiation in the interval c and no radiation in the gap b. This radiation gap will cause an increase in the side lobes of an antenna beam created with the system 20 of FIGS. 1 and 2.

With use of the equation $h/(\lambda/n)-\alpha/\lambda=N$ (developed in regard to FIG. 13), equation 4 and standard trigonometric identities, the gap b can be calculated as $$b=\frac{\lambda\tan\beta}{n-\cos\beta}$$

and the interval c as $$c=\frac{\lambda\cos\beta}{(n-\cos\beta)\tan\alpha}\ .$$

For small β, $c/b\approx 1/\alpha\beta$. Usually, $b<<\lambda$ and $c>>\lambda$, so that the effect upon the efficiency of the antenna 20 of FIG. 1 will be slight. For example, if β=7.5°and n=1.7, b=0.2 l and c=5 l.

Figure 16:
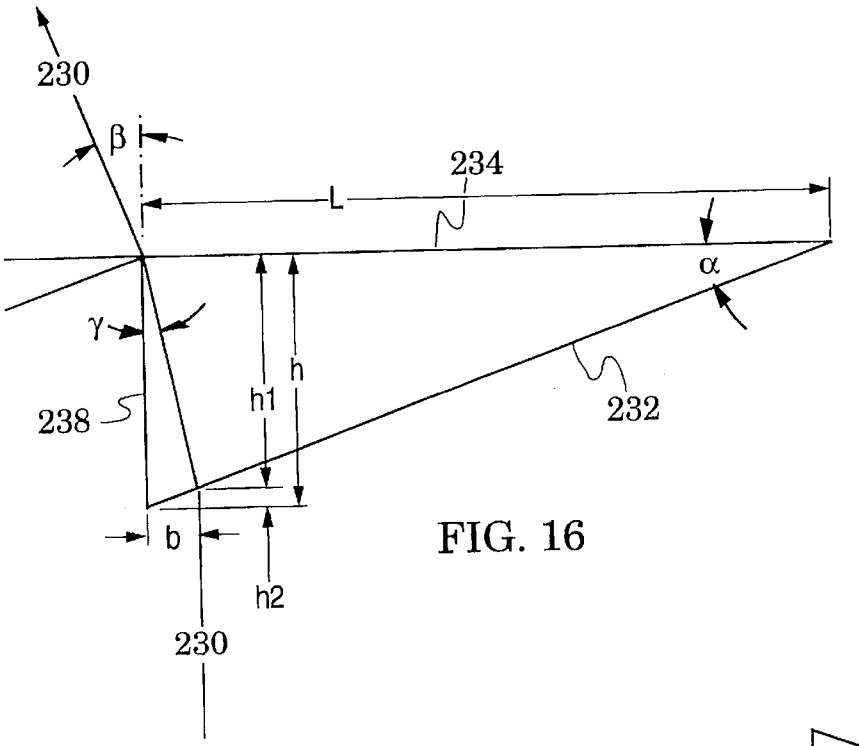
FIG. 16 is a schematic diagram which illustrates reflective losses in the antenna of FIG. 1.

FIG. 16 is a schematic which is similar to FIG. 14 and which illustrates the reactive efficiency when the contour segments are defined on the interior of the refractive tube wall (46 in FIG. 2). It can be seen that radiation rays in the region b between the ray 230 and the step 238 will be reflected from the interior side of the step and essentially lost, i.e., they will not be refracted with angle b as is the ray 230 and all other rays that are refracted across the segment 234 of length L. Thus, b/L is a measure of the energy loss. From the figure, tan α=h/L, tan γ=b/h1 and tan α=h2/b. Using these equations and standard trigonometric identities, it can be shown that $$b/L=\frac{1}{ctg\gamma ctg\alpha+1}\ .$$

For example, if n=1.7 and β=7.5° then b/L=0.0143 or a transmission loss of only 1.4%.

Figure 17:
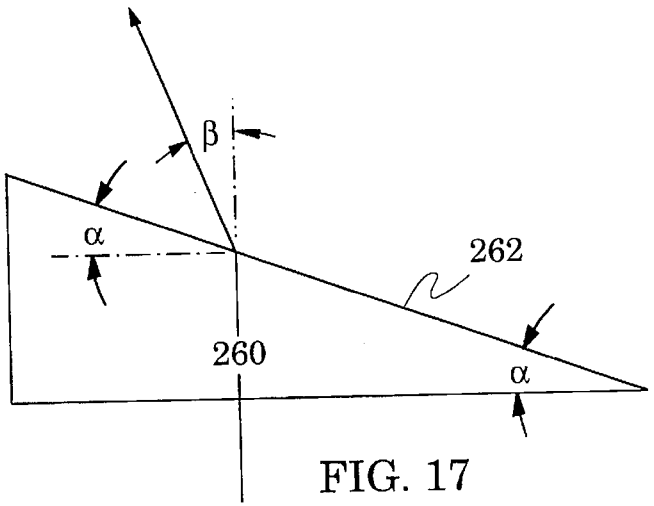
FIG. 17 is a schematic diagram which illustrates maximum refractive deviation in the antenna of FIG. 1.

FIG. 17 is a schematic illustration which facilitates a calculation of the maximum refraction angle β that is obtainable with the system 20 of FIGS. 1 and 2. For a radiation ray 260 which crosses a linear segment 262 that has an inclination α and is made from a wall having an refractive index n, the maximum angle of β will occur when β+α=90°. Substitution into equation (4) gives $$\tan(90-\beta_{max})=\frac{\sin\beta_{max}}{n-\cos\beta_{max}}$$

which can be reduced with standard trigonometric identities to $$\cos\beta_{max}=\frac{1}{n}\ .$$

For example, if n=1.7, βmax is 54°.

In accordance with the teachings of the invention, an exemplary scanned antenna for generating a radar beam of 60 GHz with a beam deviation of +/−7.5° from boresight could be realized with a refractive tube material that has a refraction index=3, a step height (184 in FIG. 13) of 2.489 mm, an axial segment dimension (L in FIG. 10C) of 38.3 mm, a maximum segment inclination (α in FIG. 10B) of 3.7°, a tube 24 outer diameter of 25 mm, a tube wall thickness of 3.5 mm and a spacing between the exit aperture (134 in FIG. 7C) and the input port (30 in FIG. 2) of 4 mm.

Attention is now directed to the scanned antenna 320 of FIGS. 3 and 4. The antenna 320 is similar to the antenna 20 of FIGS. 1 and 2 with like elements indicated by like reference numbers. However, the antenna 320 replaces the refractive tube 24 with a diffractive tube 324. For clarity of illustration, the diffractive tube 324 is also shown separately in FIGS. 18 and 19. The tube has a cylindrical wall 326 which forms a diffraction grating 328. Although the diffraction grating 328 is shown on the outer surface 329 of the wall 326, it may be formed on the inner wall surface in other embodiments of the invention.

The diffraction grating 328 includes a plurality of diffraction rings 330. The diffraction rings 330 are arranged to place different spacings in the signal plane 52 (FIG. 4) as the tube 324 rotates. For example, fewer rings 330 appear in FIG. 18 along the middle of the tube (in line with the axis 48) than along the upper edge 332 and lower edge 333 of the tube. Thus, FIG. 18 illustrates that the axial spacing of the diffraction rings is smaller at the upper and lower edges 332 and 333 than in the middle of the tube 324.

The rings 330 can be arranged in various ways to achieve different axial spacings. The arrangement of FIGS. 18 and 19 is shown again in FIG. 20 where the tube wall 326 has been cut along the plane 20—20 of FIG. 19 and rolled out into a planar wall configuration 336. The tube axis 48 is shown behind the wall configuration 336. For clarity of illustration, FIG. 20 is a schematized view in that it only shows a sampling of the diffraction rings 330. The rings have a maximum spacing 338 in the middle of the wall 326. They then angle inward from the tube ends 340 and 342 so that they have a smaller spacing 344 at the top and bottom of the wall configuration 336.

Figure 18:
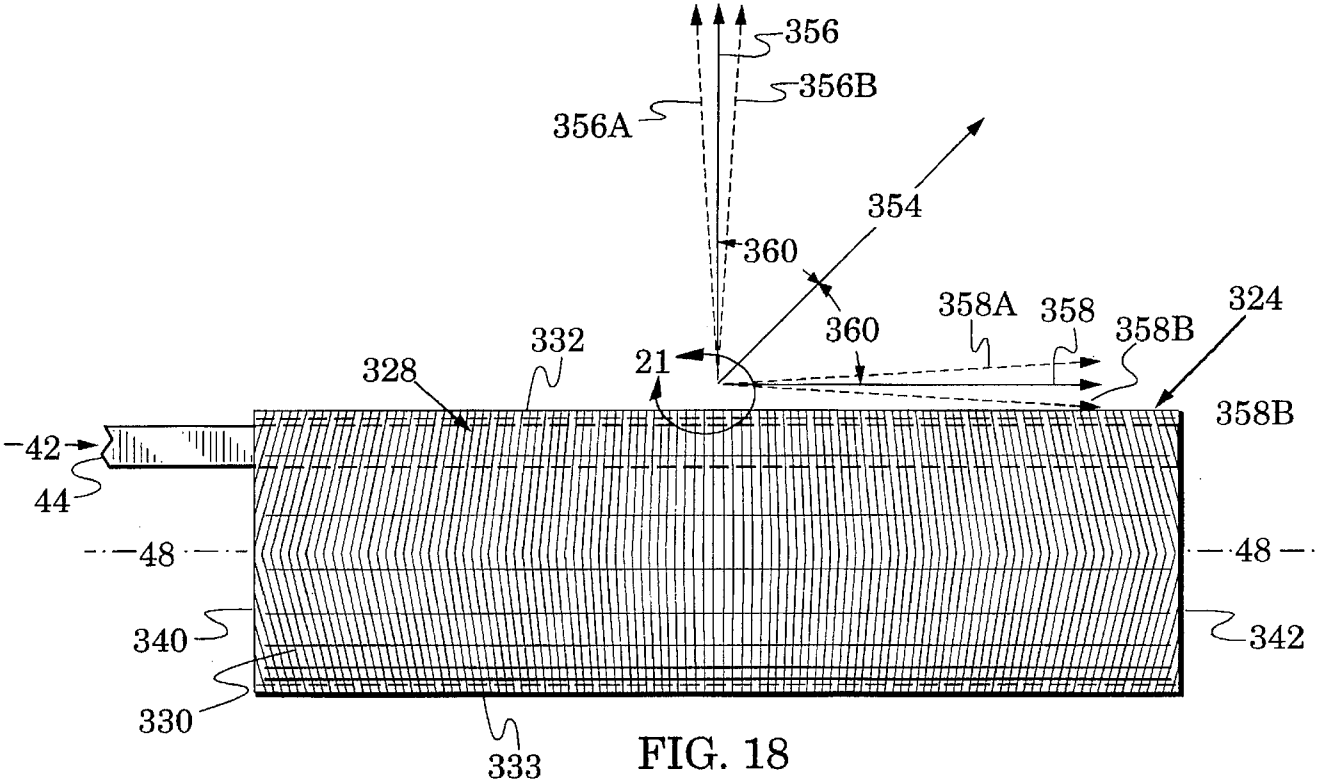
FIG. 18 is a side elevation view of a diffractive tube and a line source in the scanned antenna of FIG. 3.
Figure 21:
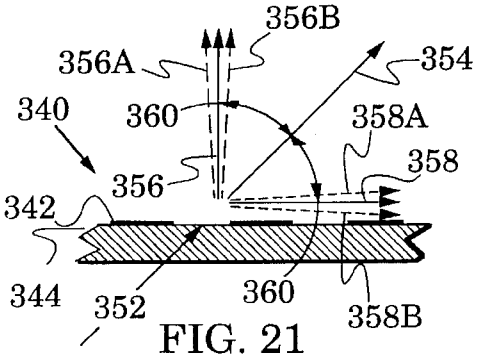
FIG. 21 is an enlarged, sectional view of the structure within the curved line 21 of FIG. 18, showing a diffraction grating.

FIG. 21 is an enlarged view of the structure within the curved line 21 of FIG. 18. It illustrates a diffraction grating embodiment 340 in which each diffraction line is formed by a plurality of metallic rings 342. A tube wall 344 is preferably made from a low-loss dielectric (e.g., Rexolite) and the rings 342 are plated on the tube surface.

Figure 19:
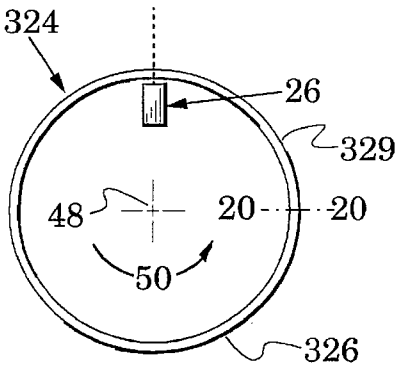
FIG. 19 is an end view of the diffractive tube and line source of FIG. 18.
Figure 20:
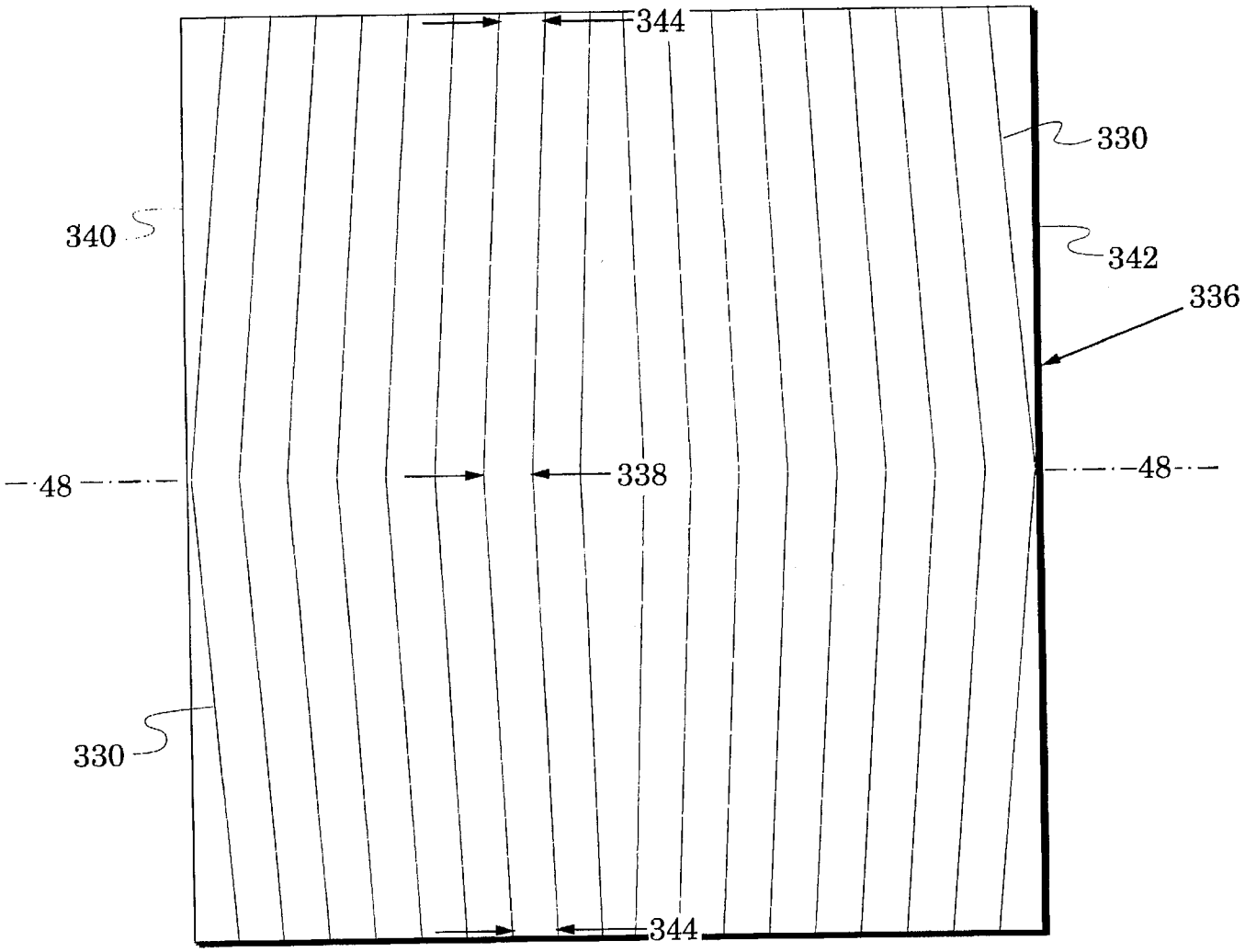
FIG. 20 is a schematized view of the diffractive tube of FIG. 18 after it has been cut along the radial plane 20—20 of FIG. 19 and rolled into a planar configuration.
Figure 22:
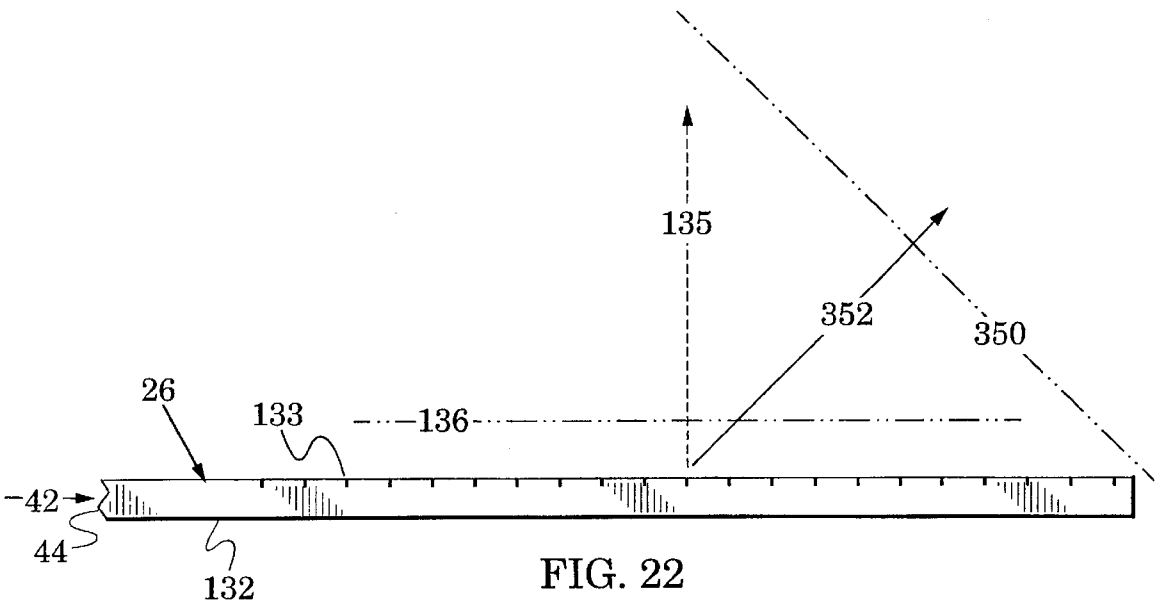
FIG. 22 is a side elevation view of the line source of FIG. 18.

The operation of the diffractive tube 324 of FIGS. 18 and 19 can be illustrated with the aid of FIG. 21 and with FIG. 22 which is similar to FIG. 7A with like elements indicated by like reference numbers. FIG. 22 illustrates the line source 26 and its radiators 133 which are transverse slots in a waveguide 132. In the scanned antenna 20 of FIGS. 1 and 2, the radiators 133 were spaced by the waveguide's wavelength $\lambda_g$ which directed an rf energy sheet 135 orthogonally upward from the waveguide 132. Accordingly, the wavefront 136 of the energy sheet 135 was parallel with the waveguide 132. In contrast, the spacing of the radiators 133 is made less than $\lambda_g$ to generate a radiation wavefront 350 in FIG. 22 which is angled relative to the line source 26. The generated rf energy sheet is directed orthogonally to its wavefront 350 as indicated by the arrow 352.

In FIG. 21, the rf energy sheet 352 is directed to be incident upon the diffraction grating 340. Diffraction then processes the incident, rf energy sheet 352 into a zero-order energy sheet 354 and a pair of first-order energy sheets 356 and 358. The zero-order energy sheet 354 is directed in the same direction as the incident, rf energy sheet 352 and the angle 360 between the direction of the zero-order energy sheet 354 and the direction of the first-order energy sheets 356 and 358 is determined by the relationship between the wavelength λ of the rf energy and the spacing of the diffraction rings 342.

In particular, the diffraction grating 340 will produce pairs of diffraction beams in accordance with the diffraction-grating equation of $m\lambda=S\sin\theta$ in which m=0,±1,±2, and so on, S is the spacing between grating lines and θ is the angle between the zero-order energy sheet and the m-order energy sheets. For example, if $S=1.414\ \lambda$, then $\theta \sim 45°$. Changes in the spacing between the diffraction lines causes a consequent change in the angle $\theta$ between the zero-order energy sheet 354 and the first-order energy sheets 356 and 358.

In operation, the tube 324 (of FIGS. 18 and 19) is rotated so that the spacing of the diffraction rings 330 across the incident, rf energy sheet 352 (of FIG. 21 or, equivalently, across the signal plane 52 in FIG. 4) is successively changed to different values. In response, the angle 360 is successively changed, i.e., the first-order diffraction sheets 356 and 358 are scanned as indicated by the broken-line arrows 356A and 356B and 358A and 358B in FIGS. 18 and 21.

By causing the incident, rf energy sheet 352 (from the line source 26 in FIG. 20) to strike the cylindrical wall 326 at an angle, the first-order energy sheet 356 is directed into the input port 30 of the radiator 22 (in FIG. 3). As the energy sheet 356 is scanned, its wavefront strikes the input port 30 at different angles to cause different phase distributions across the input port. As a result, the antenna beam boresight 40 is scanned from the output aperture 32.

Figure 24:
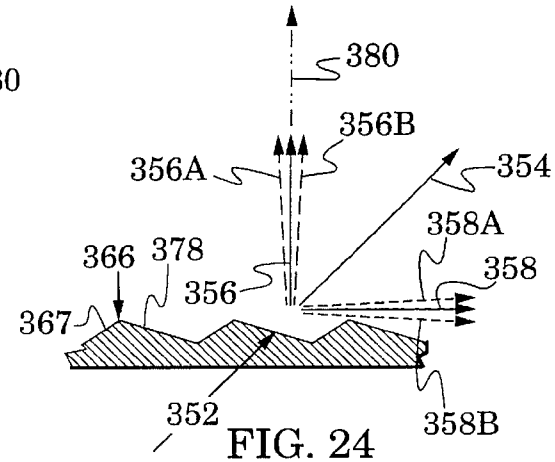
FIG. 24 is a view similar to FIG. 21, showing another diffractive grating.
Figure 23:
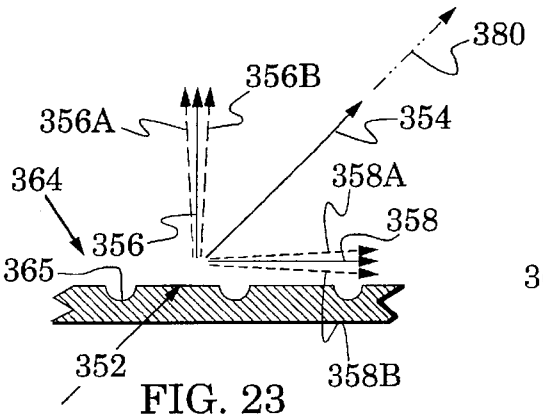
FIG. 23 is a view similar to FIG. 21, showing another diffractive grating.
Figure 25:
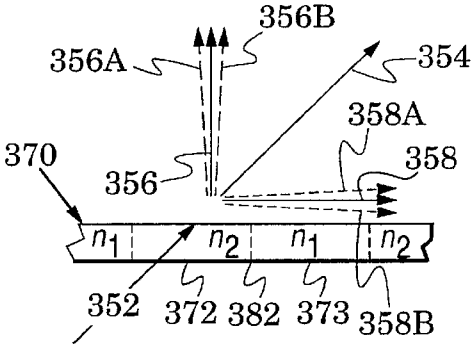
FIG. 25 is a view similar to FIG. 21, showing another diffractive grating.

Various, periodic structures can be used for the diffraction grating 328 of the tube 324 in FIG. 3. For example, FIG. 23 illustrates a diffraction grating 364 in which each diffraction ring is formed by a pair of axially-spaced, annular grooves 365. FIG. 24 illustrates another diffraction grating 366 in which each diffraction ring is formed by a pair of oppositely-inclined, annular surfaces 367 and 378. FIG. 25 illustrates another diffraction grating 370 in which periodicity is not formed by surface relief but rather, by changes in dielectric constant. Here, each diffraction ring is formed by alternating rings 372 and 373 which have different dielectric constants $n_1$ and $n_2$. FIGS. 23, 24 and 25 are otherwise similar to FIG. 21 with like elements indicated by like reference numbers. Although the diffraction rings of FIGS. 21–25 are shown with exemplary rings of equal-width, other diffraction grating embodiments can use rings of unequal width.

The angular relationship between the zero-order, rf energy sheet and the first-order, rf energy sheets is governed by the spacing of the diffraction rings. In contrast, a diffraction envelope which defines the relative energy between each of the sheets is a function of the shape of the diffraction rings. The diffraction envelope maximum occurs where the far-field path difference for energy rays which radiate from the center and edges of each diffraction ring is zero. By adjusting the shape of the diffraction rings, the diffraction envelope maximum can be shifted to enhance the energy in one diffracted energy sheet at the expense of other energy sheets.

This technique of shaping diffraction lines to shift the diffraction envelope maximum is conventionally known as "blazing". In FIG. 23, the peak of the diffraction envelope is indicated by the broken-line arrow 380. It is aligned with the zero-order, energy sheet 354. By introducing prismatic grooves as in FIG. 24, the diffraction envelope peak 380 can be shifted to align with the first-order, energy sheet 356 which is the energy sheet that is directed into the input port (30 in FIG. 3).

In the diffraction grating 370 of FIG. 25, changes in dielectric constant replace surface relief. Accordingly, the grating rings 372 and 373 can be blazed by replacing the abrupt change of dielectric constant at the boundary 382 (between the rings 372 and 373) with a graded change. Blazing techniques are discussed in detail in various references (e.g., Pedrotti, S. J., et al., *Introduction to Optics*, Prentice Hall, Englewood Cliffs, 2nd edition, 1993, pp. 349–359).

In FIG. 20, the grating lines 330 are formed of straight-line segments. Thus, the diffraction grating of FIG. 20 will cause the first-order, energy sheet 356 of FIG. 18 to scan linearly as the tube 324 is rotated at a constant angular velocity. Because the spacing between the grating lines 330 changes linearly between the maximum spacing 338 and the minumum spacing 344, the energy sheet 356 will scan linearly back and forth between the broken-line directions 356A and 356B.

Figure 26:
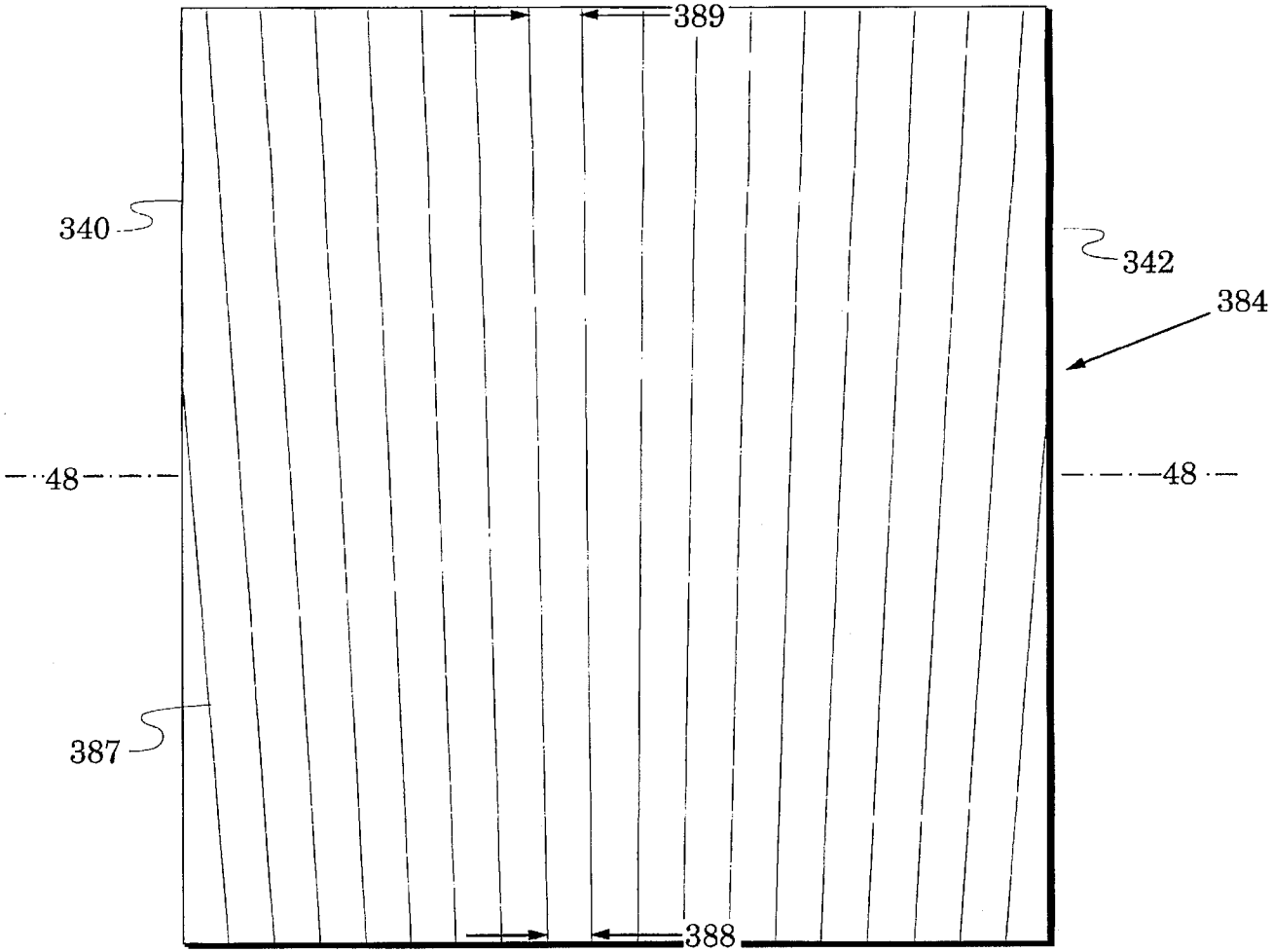
FIG. 26 is a view similar to FIG. 20, showing another diffraction grating arrangement.
Figures 27, 28:
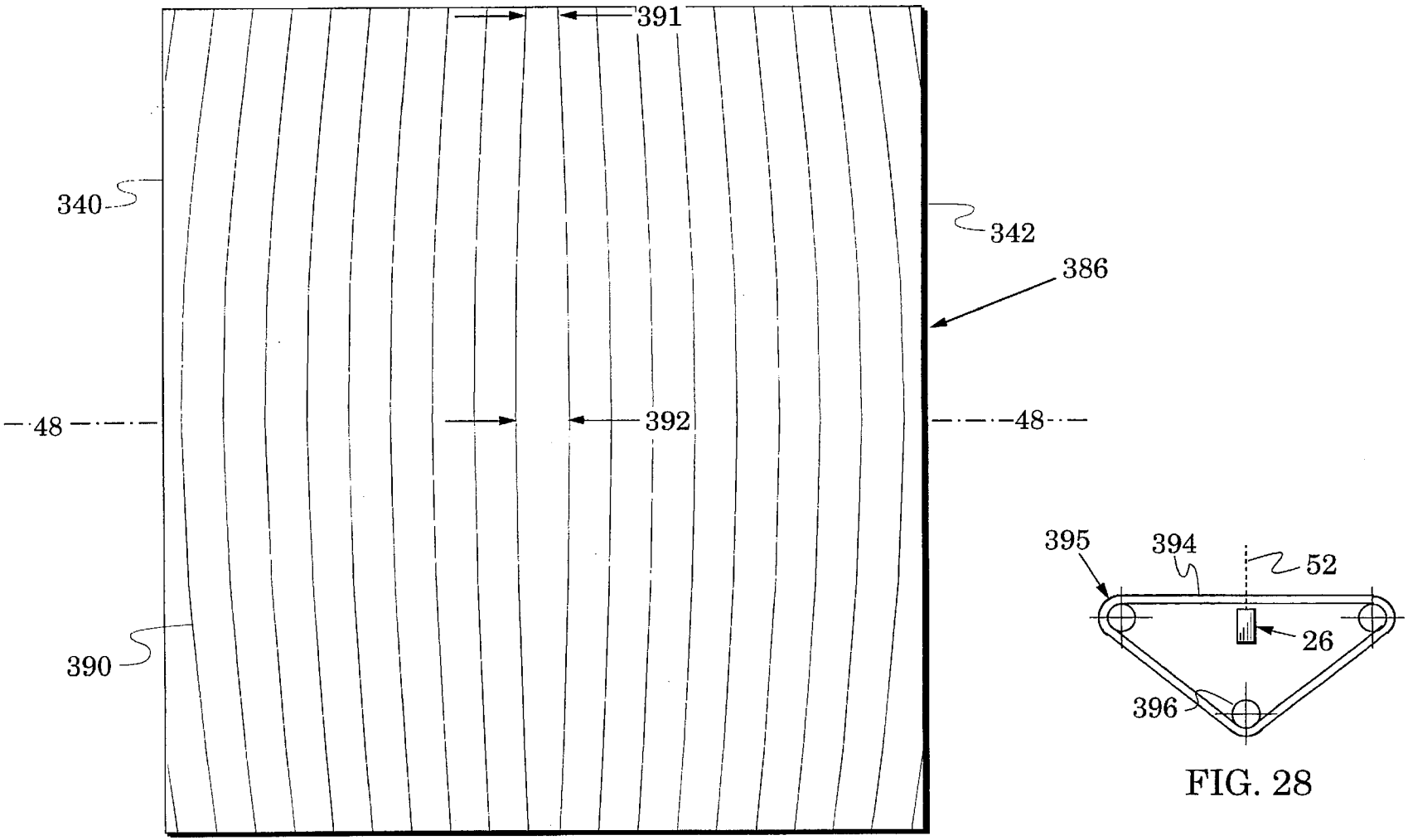
FIG. 27 is a view similar to FIG. 20, showing another diffraction grating arrangement.
FIG. 28 is a view similar to FIG. 19, which illustrates a belt that can carry the transmission structures of the invention.

FIGS. 26 and 27 are views similar to FIG. 20 with like elements indicated by like reference numbers. These figures illustrate other diffraction grating arangements 384 and 386. In the arrangement 384, the grating lines 387 change linearly from a minimum spacing 388 to a maximum spacing 389 and then abruptly change back to the minimum spacing 388. This arrangment will cause the energy sheet 356 of FIG. 18 to scan linearly from a first direction to a second direction and then, abruptly return to the first direction. The arrangements 336 and 384 of FIGS. 20 and 26 realize linear scanning with constant rotational velocity of the tube 324. In the arrangement 386 of FIG. 27, the diffraction lines 390 curve between a minimum spacing 391 and a maximum spacing 392. This grating line arrangement will realize nonlinear scanning with constant rotational velocity of the tube 324.

The transmission structures of FIGS. 1–4 have been shown to be carried through a radiation sheet on the wall of a rotating tube. The transmission structures can also be carried by other wall structures. For example, FIG. 28 illustrates a wall 394 of a belt 395 which is carried through the radiation sheet 52 (issuing from the line source 26 as in FIG. 4) with the aid of rollers 396.

Figure 29:
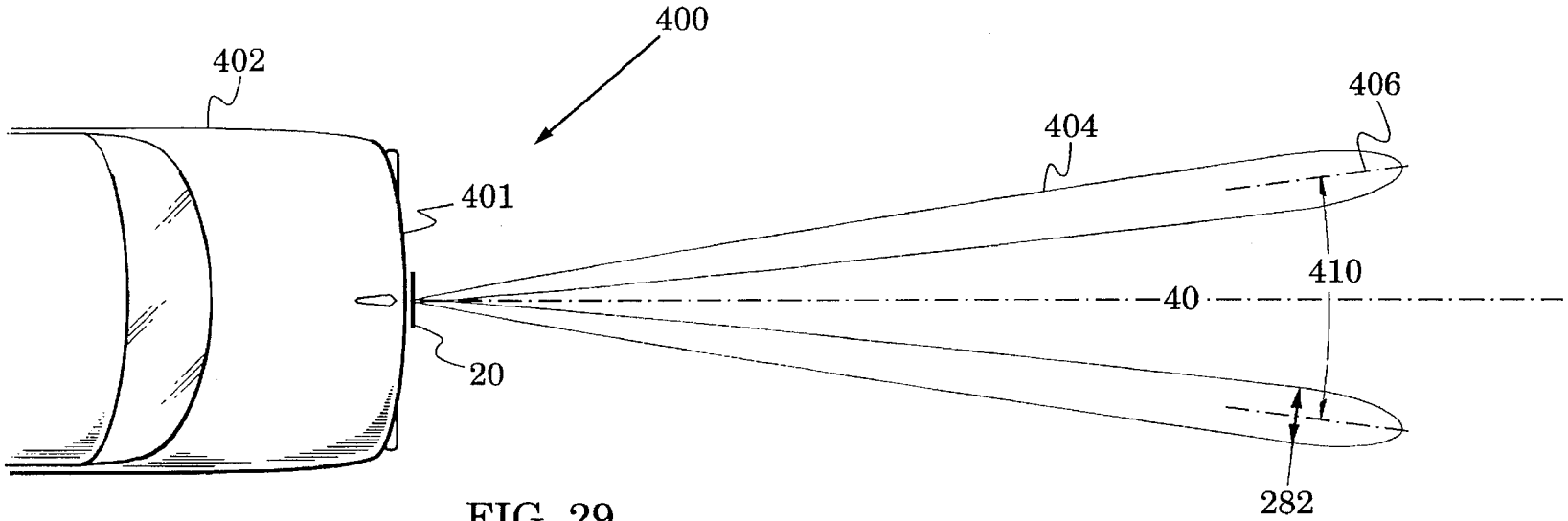
FIG. 29 is a plan view of a vehicular obstacle-avoidance system.
Figure 30:
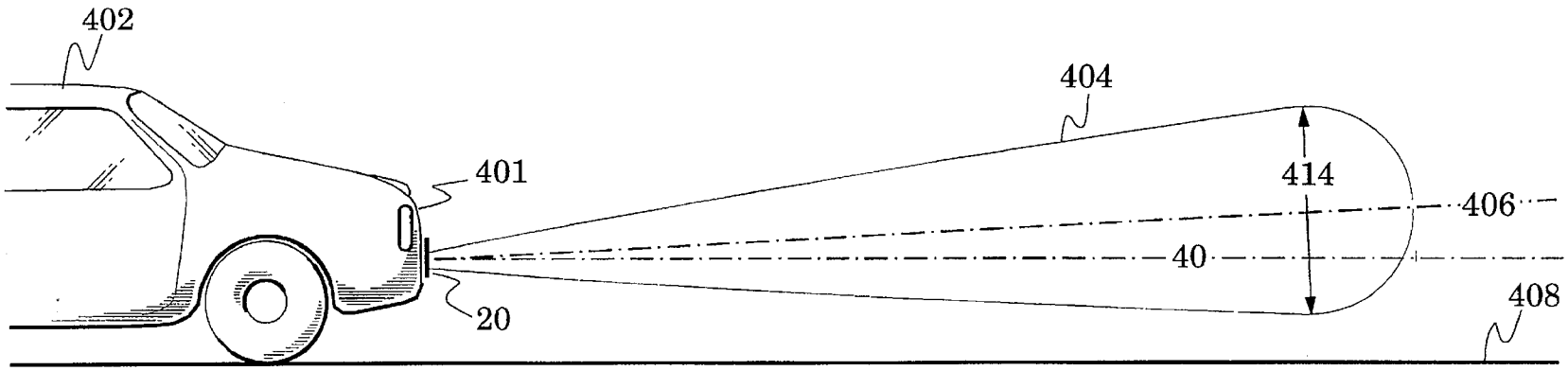
FIG. 30 is a side elevation view of the system of FIG. 29.

FIGS. 29 and 30 illustrate an obstacle-avoidance system 400 in which the scanned antenna 20 of FIGS. 1 and 2 is mounted on the front 401 of a motor vehicle 402. The antenna 20 projects an interrogating antenna beam 404 forward of the vehicle. FIG. 30 shows that the beam axis 406 has been inclined upward, in the antenna's elevation plane, from the antenna's boresight 40. This is to avoid excessive signal return from the road surface 408 and is accomplished by an appropriate selection of the spacing 106 in FIG. 6B.

In FIG. 29, the beam 404 has an angular scan 410 which is set by a selection of the maximum segment inclinations in the antenna's refractive tube (24 in FIGS. 1 and 2). To increase the antenna's azimuth resolution, the antenna's aperture dimensions (36 and 38 in FIG. 2) have been selected to give the beam 404 an azimuth width 412 that is narrower than its elevation width 414. This selection is made in accordance with the relationship $0.885\lambda/D \approx \gamma$ between an aperture's dimension D and the beam width $\gamma$ in the plane of that dimension (this relationship is found in standard antenna references, e.g., Woff, E. A., *Antenna Analysis*, Norwood, Mass., Artech House, pp.249).

In FIGS. 5A, 5B, 6A and 6B the radiator 22 is shown to include metal plating for forming parallel plates 96 and 97. In addition, the sides 92 of the transverse ribs 90 were shown to carry metallic plating. Although this plating improves the containment of microwave energy, other useful embodiments of the radiator 22 can be formed by eliminating the plating. In these radiator embodiments, the rf energy is guided by total internal reflection due to an appropriate selection of the dielectric constant of the radiator's core 82.

The radiator 22 facilitates the selection of antenna beamwidths, e.g., 282 and 284 in FIGS. 29 and 30. However, other useful embodiments of the invention may include only embodiments of the line source 26 and refractive tube 24 of FIGS. 1 and 2. In these scanned antenna embodiments, the beam width can still be adjusted in one plane by selecting the linear span of the line source's exit aperture (134 in FIG. 7C).

Scanned antennas in accordance with the present invention have few parts, require only a single moving part and can be fabricated with simple techniques. For example, the radiator 22, the refractive tube 24 and the line source 26 can all be fabricated by simple shaping of a low-loss dielectric material. In addition, the movement of the tube 24 is a rotary movement which inherently provides longer system life than part movements which involve greater acceleration changes, e.g., reciprocal movements.

The invention obtains large antenna beam deviations with a relatively thin refraction wall (46 in FIG. 2), which reduces the spatial volume of the antenna. The thin wall also allows the spacing between the line source's exit aperture 134 and the radiator's input port 30 to be reduced, which increases the system efficiency. This efficiency increase occurs because the curved tube wall 46 necessarily causes some refractive spreading of the radiation sheet from the line source's exit aperture 134. A reduction of the spacing from the input port 30 will reduce the amount of rf energy that exceeds the entry width of the input port 30. For a further increase in system efficiency, the surfaces of the refractive tube 24 can include conventional antireflection treatments, e.g., antireflection coatings and quarter-wave grooved rulings.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A scanned antenna for converting a radio frequency (rf) signal into a scanned antenna beam, comprising:

a radiative member formed with an input port and an output aperture and configured to radiate rf energy that is received through said input port as an antenna beam from said output aperture, wherein said antenna beam has a phase distribution across said output aperture that is a function of the phase distribution of said rf energy across said input port;

a radiative line source having an entrance port and an exit aperture, said exit aperture spaced from said input port and configured to illuminate, in response to said rf signal at said entrance port, said input port with a sheet of rf energy which is directed along a signal plane that extends between said exit aperture and said input port;

a rotatable, transmission member having a cylindrical wall formed about a rotational axis, said transmission member positioned with said exit aperture received within said cylindrical wall; and a plurality of different transmission structures, each positioned on said cylindrical wall to be across said signal plane as said transmission member is rotated about said axis to a different one of a plurality of rotational positions;

each of said different transmission structures configured to process said rf energy sheet with a different one of a plurality of transfer functions to direct a processed rf energy sheet into said input port with wavefronts which are each sloped at a different one of a plurality of wavefront angles with said input port, said different wavefront angles causing said processed rf energy sheet to have different phase distributions across said input port.

2. The scanned antenna of claim 1, wherein:

said cylindrical wall has an inner and an outer surface; and said cylindrical wall is formed of a material with a refractive index which differs from the refractive index of air;

and said different transmission structures include:

a plurality of different contours formed by one of said inner and outer surfaces;

a plurality of first linear segments formed by a first one of said contours, said first linear segments arranged so they are not colinear but have substantially the same first inclination from said axis; and a plurality of second linear segments formed by a second one of said contours, said second linear segments arranged so they are not colinear but have substantially the same second inclination from said axis, said first inclination arranged to differ from said second inclination.

3. The scanned antenna of claim 1, wherein:

said cylindrical wall has an inner and an outer surface; and said different transmission structures include a diffraction grating formed with a plurality of diffraction rings on one of said inner and outer surfaces, said diffraction grating arranged to have, in said signal plane, different axial spacings between said diffraction rings as said transmission member is rotated about said axis to different ones of said rotational positions.

4. A scanned antenna for converting a radio frequency (rf) signal with a wavelength $\lambda$ into a scanned antenna beam, comprising:

a radiative member formed with an input port and an output aperture and configured to radiate rf energy that is received through said input port as an antenna beam from said output aperture, wherein said antenna beam has a phase distribution across said output aperture that is a function of the phase distribution of said rf energy across said input port;

a radiative line source having an entrance port and an exit aperture, said exit aperture spaced from said input port and configured to illuminate, in response to said rf signal at said entrance port, said input port with a sheet of rf energy which is directed along a signal plane that extends between said exit aperture and said input port;

a rotatable, refractive member having a cylindrical wall formed about a rotational axis, said cylindrical wall formed of a material with a refractive index n and having an inner and an outer surface, said refractive member positioned with said exit aperture received within said cylindrical wall; and a plurality of different contours formed by one of said inner and outer surfaces and each positioned on said cylindrical wall to be across said signal plane as said refractive member is rotated about said axis to a different one of a plurality of rotational positions;

wherein:

a first one of said contours includes a plurality of first linear segments which are not colinear and which have substantially the same first inclination from said axis;

a second one of said contours includes a plurality of second linear segments which are not colinear and which have substantially the same second inclination from said axis; and said first inclination differs from said second inclination;

said different contours causing said rf energy sheet to have different phase distributions across said input port.

5. The scanned antenna of claim 4, wherein adjacent ends of at least one pair of said first linear segments and at least one pair of said second linear segments have radial offsets from said axis that differ by substantially $N\lambda/(n-1)$ in which N is a positive integer.

6. The scanned antenna of claim 4, wherein:

a set of said contours are positioned within an angular portion of said refractive member;

each of said set of contours includes a plurality of linear segments which are not colinear and which have substantially the same inclination from said axis;

in each of said set of contours, adjacent ends of a pair of linear segments meet at a step having a radial dimension of substantially $N\lambda/(n-1)$, where N is a positive integer; and each of said steps are positioned along a line which would be defined by a hyperbola if said cylindrical wall were cut axially and rolled into a planar configuration.

7. The scanned antenna of claim 4, wherein a third one of said contours includes only one linear segment that has a third inclination from said axis.

8. The scanned antenna of claim 4, wherein said radiative member includes;

a parallel-plate waveguide formed of first and second spaced plates which terminate at an edge that defines said input port; and a plurality of parallel-plate stubs that are arranged to issue from one of said plates to define said output aperture.

9. The scanned antenna of claim 4, wherein said radiative member incudes;

a dielectric panel having a side and an edge, said edge defining said input port; and a plurality of dielectric ribs that are arranged to issue from said panel side to define said output aperture.

10. The scanned antenna of claim 4, wherein said radiative member is a continuous transverse stub structure.

11. The scanned antenna of claim 4, wherein said line source includes a plurality of linearly-spaced, radiative elements.

12. The scanned antenna of claim 11, wherein said line source further includes a waveguide and said radiative elements each comprise an opening in said waveguide.

13. The scanned antenna of claim 11, wherein said line source further includes a dielectric rod and said radiative elements each comprise a conductive patch carried on said rod.

14. The scanned antenna of claim 11, wherein said line source further includes a dielectric rod and said radiative elements each comprise a dielectric stub extending from said rod.

15. A scanned antenna for converting a radio frequency (rf) signal with a wavelength $\lambda$ into a scanned antenna beam, comprising:

a radiative member formed with an input port and an output aperture and configured to radiate rf energy that is received through said input port as an antenna beam from said output aperture, wherein said antenna beam has a phase distribution across said output aperture that is a function of the phase distribution of said rf energy across said input port;

a radiative line source having an entrance port and an exit aperture, said exit aperture spaced from said input port and configured to illuminate, in response to said rf signal at said entrance port, said input port with a sheet of rf energy which is directed along a signal plane that extends between said exit aperture and said input port;

a rotatable, diffractive member having a cylindrical wall formed about a rotational axis, said cylindrical wall having an inner and an outer surface and said diffractive member positioned with said exit aperture received within said cylindrical wall; and a diffraction grating formed with a plurality of diffraction rings on one of said inner and outer surfaces;

wherein:

said diffraction grating is arranged to have, in said signal plane, different axial spacings between said diffraction rings as said diffractive member is rotated about said axis to different rotational positions, said diffraction grating processing said rf energy sheet into a zero-order, rf energy sheet and a pair of first-order, rf energy sheets; and said radiative line source adapted to direct a predetermined one of said first-order, rf energy sheets into said input port;

said different, diffraction-grating spacings causing said predetermined, first-order, rf energy sheet to have different phase distributions across said input port.

16. The scanned antenna of claim 15, wherein:

said cylindrical wall comprises a substantially radiation-transparent material; and each of said diffraction rings comprises an annular, conductive strip.

17. The scanned antenna of claim 15, wherein:

said cylindrical wall comprises a substantially radiation-transparent material; and each of said diffraction rings comprises adjoining, annular portions of said wall which have different dielectric constants.

18. The scanned antenna of claim 15, wherein:

said cylindrical wall comprises a substantially radiation-transparent material; and each of said diffraction rings comprises a pair of oppositely-inclined surfaces.

19. The scanned antenna of claim 15, wherein said radiative member includes;

a parallel-plate waveguide formed of first and second spaced plates which terminate at an edge that defines said input port; and a plurality of parallel-plate stubs that are arranged to issue from one of said plates to define said output aperture.

20. The scanned antenna of claim i5, wherein said radiative member incudes;

a dielectric panel having a side and an edge, said edge defining said input port; and a plurality of dielectric ribs that are arranged to issue from said panel side to define said output aperture.

21. The scanned antenna of claim 15, wherein said radiative member is a continuous transverse stub structure.

22. The scanned antenna of claim 15, wherein:

said line source includes a plurality of linearly-spaced, radiative elements;

said rf signal has a wavelength $\lambda_g$ in said line source; and said radiative elements are spaced differently from $\lambda_g$ to direct a predetermined one of said first-order rf energy sheets to said input port.

23. The scanned antenna of claim 22, wherein:

the energy in said zero-order, rf energy sheet and said pair of first-order, rf energy sheets is a function of a diffraction envelope;

said diffraction envelope has a maximum; and said diffraction rings are blazed to substantially align said diffraction envelope maximum with said predetermined first-order rf energy sheet.

24. The scanned antenna of claim 22, wherein said line source further includes a waveguide and said radiative elements each comprise an opening in said waveguide.

25. The scanned antenna of claim 22, wherein said line source further includes a dielectric rod and said radiative elements each comprise a conductive patch carried on said rod.

26. The scanned antenna of claim 22, wherein said line source further includes a dielectric rod and said radiative elements each comprise a dielectric stub extending from said rod.

27. A scanned antenna for converting a radio frequency (rf) signal into a scanned antenna beam, comprising:

a radiative line source having an entrance port and an exit aperture, said exit aperture configured to radiate, in response to said rf signal at said entrance port, an antenna beam in the form of a sheet of rf energy; and a rotatable, transmission member having a cylindrical wall formed about a rotational axis, said transmission member positioned with said exit aperture received within said cylindrical wall; and a plurality of different transmission structures, each positioned on said cylindrical wall to be across said rf energy sheet as said transmission member is rotated about said axis to a different one of a plurality of rotational positions;

each of said different transmission structures configured to process said rf energy sheet with a different one of a plurality of transfer functions to generate a processed rf energy sheet with wavefronts which are each sloped at a different one of a plurality of angles with said exit aperture, said different angles causing said processed rf energy sheet to be scanned.

28. The scanned antenna of claim 27, wherein:

said cylindrical wall has an inner and an outer surface; and said cylindrical wall is formed of a material with a refractive index which differs from the refractive index of air;

and said different transmission structures include:

a plurality of different contours formed by one of said inner and outer surfaces;

a plurality of first linear segments formed by a first one of said contours, said first linear segments arranged so they are not colinear but have substantially the same first inclination from said axis; and a plurality of second linear segments formed by a second one of said contours, said second linear segments arranged so they are not colinear but have substantially the same second inclination from said axis, said first inclination arranged to differ from said second inclination.

29. The scanned antenna of claim 27, wherein:

said cylindrical wall has an inner and an outer surface; and said different transmission structures include a diffraction grating formed with a plurality of diffraction rings on one of said inner and outer surfaces, said diffraction grating arranged to have, in said rf energy sheet, different axial spacings between said diffraction rings as said transmission member is rotated about said axis to different ones of said rotational positions.

30. A scanned antenna for converting a radio frequency (rf) signal with a wavelength $\lambda$ into a scanned antenna beam, comprising:

a radiative line source having an entrance port and an exit aperture, said exit aperture configured to radiate, in response to said rf signal at said entrance port, an antenna beam in the form of a sheet of rf energy;

a rotatable, refractive member having a cylindrical wall formed about a rotational axis, said cylindrical wall formed of a material with a refractive index n and having an inner and an outer surface, said refractive member positioned with said exit aperture received within said cylindrical wall; and a plurality of different contours formed by one of said inner and outer energy sheet as said retractive member is rotated about said axis to a different one of a plurality of rotational positions;

wherein:

a first one of said contours includes a plurality of first linear segments which are not colinear and which have substantially the same first inclination from said axis;

a second one of said contours includes a plurality of second linear segments which are not colinear and which have substantially the same second inclination from said axis; and said first inclination differs from said second inclination;

said different contours causing said rf energy sheet to have wavefronts which are each sloped at a different one of a plurality of angles with said exit aperture, said different wavefront angles causing said rf energy sheet to be scanned.

31. The scanned antenna of claim 30, wherein adjacent ends of at least one pair of said first linear segments and at least one pair of said second linear segments have radial offsets from said axis that differ by substantially $N\lambda/(n-1)$ in which N is a positive integer.

32. The scanned antenna of claim 30, wherein:

a set of said contours are positioned within an angular portion of said refractive member;

each of said set of contours includes a plurality of linear segments which are not colinear and which have substantially the same inclination from said axis;

in each of said set of contours, adjacent ends of a pair of linear segments meet at a step having a radial dimension of substantially $N\lambda/(n-1)$, where N is a positive integer; and each of said steps are positioned along a line which would be defined by a hyperbola if said cylindrical wall were cut axially and rolled into a planar configuration.

33. The scanned antenna of claim 30, wherein a third one of said contours includes only one linear segment that has a third inclination from said axis.

34. The scanned antenna of claim 30, wherein said line source includes a plurality of linearly-spaced, radiative elements.

35. The scanned antenna of claim 34, wherein said line source further includes a waveguide and said radiative elements each comprise an opening in said waveguide.

36. The scanned antenna of claim 34, wherein said line source further includes a dielectric rod and said radiative elements each comprise a conductive patch carried on said rod.

37. The scanned antenna of claim 34, wherein said line source further includes a dielectric rod and said radiative elements each comprise a dielectric stub extending from said rod.

38. A scanned antenna for converting a radio frequency (rf) signal into at least one scanned antenna beam, comprising:

a radiative line source having an entrance port and an exit aperture, said exit aperture configured to radiate, in response to said rf signal at said entrance port, an antenna beam in the form of a sheet of rf energy;

a rotatable, diffractive member having a cylindrical wall formed about a rotational axis, said cylindrical wall having an inner and an outer surface and said diffractive member positioned with said exit aperture received within said cylindrical wall; and a diffraction grating formed with a plurality of diffraction rings on one of said inner and outer surfaces;

wherein:

said diffraction grating is arranged to have, across said rf energy sheet, different axial spacings between said diffraction rings as said diffractive member is rotated about said axis to different rotational positions;

said diffraction grating processing said rf energy sheet into a zero-order, rf energy sheet and a pair of first-order, rf energy sheets; and said different, diffraction-grating spacings causing said first-order, rf energy sheets to each have wavefronts which are each sloped at a different one of a plurality of angles with said exit aperture, said different wavefront angles causing said first-order, rf energy sheets to be scanned.

39. The scanned antenna of claim 38, wherein:

said cylindrical wall comprises a substantially radiation-transparent material; and each of said diffraction rings comprises an annular, conductive strip.

40. The scanned antenna of claim 38, wherein:

said cylindrical wall comprises a substantially radiation-transparent material; and each of said diffraction rings comprises adjoining, annular portions of said wall which have different dielectric constants.

41. The scanned antenna of claim 38, wherein:

said cylindrical wall comprises a substantially radiation-transparent material; and each of said diffraction rings comprises a pair of annular, axially-inclined surfaces.

42. The scanned antenna of claim 38, wherein:

said line source includes a plurality of linearly-spaced, radiative elements;

said rf signal has a wavelength $\lambda_g$ in said line source; and said radiative elements are spaced differently from $\lambda_g$ to rotate a predetermined one of said first-order rf energy sheets to be substantially orthogonal with said exit aperture.

43. The scanned antenna of claim 42, wherein:

the energy in said zero-order, rf energy sheet and said pair of first-order, rf energy sheets is a function of a diffraction envelope;

said diffraction envelope has a maximum; and said diffraction rings are blazed to substantially align said diffraction envelope maximum with said predetermined first-order rf energy sheet.

44. The scanned antenna of claim 42, wherein said line source further includes a waveguide and said radiative elements each comprise an opening in said waveguide.

45. The scanned antenna of claim 42, wherein said line source further includes a dielectric rod and said radiative elements each comprise a conductive patch carried on said rod.

46. The scanned antenna of claim 42, wherein said line source comprises a dielectric rod and said radiative elements each comprise a dielectric stub extending from said rod.

47. An obstacle-avoidance system for generating a scanned antenna beam from a microwave signal, comprising:

a motor vehicle; and a scanned antenna carried on said vehicle, wherein said antenna includes:

a) a radiative member formed with an input port and an output aperture and configured to radiate rf energy that is received through said input port as an antenna beam from said output aperture, wherein said antenna beam has a phase distribution across said output aperture that is a function of the phase distribution of said rf energy across said input port;

b) a radiative line source having an entrance port and an exit aperture, said exit aperture spaced from said input port and configured to illuminate, in response to said microwave signal at said entrance port, said input port with a sheet of rf energy which is directed along a signal plane that extends between said exit aperture and said input port;

c) a rotatable, transmission member having a cylindrical wall formed about a rotational axis, said transmission member positioned with said exit aperture received within said cylindrical wall; and d) a plurality of different transmission structures, each positioned on said cylindrical wall to be across said signal plane as said transmission member is rotated about said axis to a different one of a plurality of rotational positions;

each of said different transmission structures configured to process said rf energy sheet with a different one of a plurality of transfer functions to direct a processed rf energy sheet into said input port with wavefronts which are each sloped at a different one of a plurality of angles with said input port, said different angles causing said processed rf energy sheet to have different phase distributions across said input port.

48. The system of claim 47, wherein:

said cylindrical wall defines a refractive member that has an inner and an outer surface and is formed of a material with a refractive index which differs from the refractive index of air;

and said different transmission structures include:

a plurality of different contours formed across said signal plane by one of said inner and outer surfaces as said transmission member is rotated about said axis;

a plurality of first linear segments formed by a first one of said contours, said first linear segments arranged so they are not colinear but have substantially the same first inclination from said axis; and a plurality of second linear segments formed by a second one of said contours, said second linear segments arranged so they are not colinear but have substantially the same second inclination from said axis, said first inclination arranged to differ from said second inclination.

49. The system of claim 47, wherein:

said cylindrical wall has an inner and an outer surface; and said different transmission structures include a diffraction grating formed with a plurality of diffraction rings on one of said inner and outer surfaces, said diffraction grating arranged to have, in said signal plane, different axial spacings between said diffraction rings as said transmission member is rotated about said axis to different ones of said rotational positions.

50. A scanned antenna for converting a radio frequency (rf) signal with a wavelength $\lambda$ into a scanned antenna beam, comprising:

a radiative line source having an entrance port and an exit aperture, said exit aperture configured to radiate, in response to said rf signal at said entrance port, an antenna beam in the form of a sheet of rf energy;

a refractive belt having a wall with an ifiner and an outer surface and formed of a material with a refractive index n, said refractive belt positioned with said exit aperture directed at said wall; and a plurality of different contours formed by one of said inner and outer surfaces and each positioned on said wall to be across said rf energy sheet as said belt is moved past said exit aperture to a different one of a plurality of positions;

wherein:

a first one of said contdurs includes a plurality of first linear segments which are not colinear and which have substantially the same first inclination from said exit aperture;

a second one of said contours includes a plurality of second linear segments which are not colinear and which have substantially the same second inclination from said exit aperture; and said first inclination differs from said second inclination;

said different contours causing said rf energy sheet to have wavefronts which are each sloped at a different one of a plurality of angles with said exit aperture, said different wavefront angles causing said rf energy sheet to be scanned.

51. The scanned antenna of claim 50, wherein adjacent ends of at least one pair of said first linear segments and at least one pair of said second linear segments are spaced across said belt by substantially $N\lambda/(n-1)$ in which N is a positive integer.

52. A scanned antenna for converting a radio frequency (rf) signal into at least one scanned antenna beam, comprising:

a radiative line source having an entrance port and an exit aperture, said exit aperture configured to radiate, in response to said rf signal at said entrance port, an antenna beam in the form of a sheet of rf energy;

a diffractive belt having a wall with an inner and an outer surface, said diffractive belt positioned with said exit aperture directed at said wall; and a diffraction grating formed with a plurality of diffraction lines on one of said inner and outer surfaces;

wherein:

said diffraction grating is arranged to have, across said rf energy sheet, different spacings between said diffraction lines as said belt is moved past said exit aperture to a different one of a plurality of positions;

said diffraction grating processing said rf energy sheet into a zero-order, rf energy sheet and a pair of first-order, rf energy sheets; and said different, diffraction-grating spacings causing said first-order, rf energy sheets to each have wavefronts which are each sloped at a different one of a plurality of angles with said exit aperture, said different wavefront angles causing said first-order, rf energy sheets to be scanned.

53. The scanned antenna of claim 52, wherein:

said line source includes a plurality of linearly-spaced, radiative elements;

said rf signal has a wavelength $\lambda_g$ in said line source; and said radiative elements are spaced differently from $\lambda_g$ to rotate a predetermined one of said first-order rf energy sheets to be substantially orthogonal with said exit aperture.

54. The scanned antenna of claim 52, wherein:

the energy in said zero-order, rf energy sheet and said pair of first-order, rf energy sheets is a function of a diffraction envelope;

said diffraction envelope has a maximum; and said diffraction rings are blazed to substantially align said diffraction envelope maximum with said predetermined first-order rf energy sheet.

* * * * *